US008269120B1

(12) United States Patent
Flegel et al.

(10) Patent No.: US 8,269,120 B1
(45) Date of Patent: Sep. 18, 2012

(54) INTERLOCK ASSEMBLY FOR USE WITH PAIR OF ALIGNED SWITCHES

(75) Inventors: David D. Flegel, Racine, WI (US); J. Mark Wilkinson, Port Washington, WI (US)

(73) Assignee: Reliance Controls Corporation, Racine, WI (US)

( * ) Notice: Subject to any disclaimer, the term of this patent is extended or adjusted under 35 U.S.C. 154(b) by 334 days.

(21) Appl. No.: 12/509,779

(22) Filed: Jul. 27, 2009

(51) Int. Cl.
*H01H 9/20* (2006.01)

(52) U.S. Cl. ..... 200/50.33; 200/43.11

(58) Field of Classification Search ..... 200/50.32, 200/50.33, 50.4, 50.11, 50.19, 50.21, 43.11, 200/43.14–43.19
See application file for complete search history.

(56) References Cited

U.S. PATENT DOCUMENTS 4,882,456 A * 11/1989 Hovanic et al. ..... 200/43.15
5,310,969 A * 5/1994 Turek et al. ..... 200/43.14
5,349,145 A * 9/1994 Kelaita et al. ..... 200/43.15
5,577,599 A * 11/1996 Turek et al. ..... 200/43.14
5,648,646 A 7/1997 Flegel
6,031,193 A 2/2000 Flegel
6,096,986 A 8/2000 Flegel
6,160,227 A * 12/2000 Singer ..... 200/43.14
6,184,595 B1 2/2001 Flegel
6,521,849 B1 2/2003 Flegel
6,621,689 B1 9/2003 Flegel
6,861,596 B2 * 3/2005 Schnackenberg ..... 200/43.01
6,927,349 B1 8/2005 Flegel et al.
7,238,898 B1 7/2007 Czarnecki
7,462,791 B1 12/2008 Flegel
7,531,762 B2 5/2009 Flegel

* cited by examiner

*Primary Examiner* — Xuong Chung Trans
(74) *Attorney, Agent, or Firm* — Boyle Fredrickson, S.C.

(57) ABSTRACT

A system and method of interlocking a plurality of electrical panel switches includes an interlock assembly having an interlock. The interlock has a first position that allows connection of one of utility power and power from an alternate power supply, such as a generator, to the electrical panel and prevents connection of the other of the utility power and alternate power. The interlock has a second position that allows connection of the other of the utility power and alternate power and prevents connection of one of the utility power and alternate power to the electrical panel. The interlock also is constructed to control the positioning and sequence of operation of neutral connections between the power supplies and the electrical panel.

20 Claims, 19 Drawing Sheets

INTERLOCK ASSEMBLY FOR USE WITH PAIR OF ALIGNED SWITCHES

BACKGROUND OF THE INVENTION

The present invention relates generally to electrical panels and, more particularly, to a power supply or input interlock assembly constructed to electrically isolate different inputs connected to an electrical panel.

Electrical panels, breaker boxes, or load centers frequently include a main contactor, switch, or breaker, which electrically isolates a series of load breakers from a utility power input. Occasionally, such load panels are configured to receive another input power source, such as from a generator, to provide electrical power to the individual loads in the event of a utility power failure. During interruption of utility power, the generator supplies power to the load center, which the load center distributes to the selected or designated circuits of the building. Before activating the generator power supply, the main switch must be disconnected or turned "OFF" to prevent the generator power from back-feeding through the utility conductors. A user must manually configure the switches of the load center to electrically connect the generator power with the series of loads and electrically isolate the utility power from the generator power, and vice-versa. In order to maintain electrical isolation between the generator power input and the utility power input, the connection/disconnection of the utility power supply and generator power supply must be performed in a specific sequence to ensure electrical isolation of the respective power input sources. An interlock system has been developed for carrying out this function, and is shown and described in Flegel U.S. Pat. No. 6,621,689 issued Sep. 16, 2003, the disclosure of which is hereby incorporated by reference in its entirety. While the system shown in the '689 patent controls operation of a main power supply ON/OFF switch and an auxiliary power supply ON/OFF switch, it contains no provisions for controlling operation of neutral switches associated with the main and auxiliary power supplies.

When a bonded neutral generator is connected to the wiring system of a building, the grounding conductor and the neutral conductor are connected in two places within the system. This allows for the return of current back to the generator to flow on both the grounding conductor and on the neutral conductor. Having normal current flow on the grounding conductor limits the ability of the grounding conductor to perform its safety function, and is therefore undesirable. Switching the neutral conductor(s) when switching the power supply conductors prevents any neutral current from flowing on the grounding conductor. Furthermore, it is important to control the sequence of operation of the generator and utility neutral switches when switching between power sources, since supplying power to a device without a neutral may result in failure of the device due to an unpredictable voltage being supplied to the device. To prevent this occurrence, the switching sequence is as follows when switching from main utility power to generator power:

1. Turn off main power;
2. Turn off main neutral;
3. Turn on generator neutral;
4. Turn on generator power.

This sequence is reversed when switching from generator power to utility power.

For the above reasons, it is desirable to provide an input interlock assembly that ensures electrical isolation of the utility power and the generator power during a transfer of the input power from one source to another, and which controls the sequence of operation of neutral switches associated with the utility and generator power supplies.

SUMMARY OF THE INVENTION

In accordance with the present invention, a pair of switches, such as may be interconnected with separate sources of electrical power, are engaged with an electrical contact member associated with an electrical panel or the like. The switches are aligned with each other, and include operating members movable between ON and OFF positions. An interlock arrangement is adapted to interact with the switch operating members, and is configured to prevent the operating members from being in the ON position at the same time. In addition, the interlock arrangement is configured such that it cannot be inadvertently disassociated with or removed from the pair of switches.

According to one aspect of the invention, an electrical assembly for use in combination with an electrical contact arrangement is provided and includes a pair of aligned switches, wherein each of the switches is engaged with the contact arrangement, and wherein each of the switches has an operating member movable between an ON position and an OFF position. An interlock arrangement includes actuating structure that interacts with the switch operating members for preventing both switches from being in the ON position at the same time, and the interlock arrangement is configured to interact with the operating members to maintain the switches in engagement with the contact arrangement. Further, the interlock arrangement includes a first slidable member associated with a first operating member and a second slidable member associated with a second operating member and further includes a bridge interconnecting the first and the second slidable members.

According to another aspect of the invention, an interlock for use with a pair of aligned switches comprised of first and second switch members spaced from one another and operative to selectively electrically connect an electrical load to either a primary power supply or an auxiliary power supply is provided. The interlock includes a first interlock member adjacent to the first switch member and configured to slide with movement of the first switch member, a second interlock member adjacent to the second switch member and configured to slide with movement of the second switch member, and a bridge interlock member coupled to the first interlock member and the second interlock member such that movement of either one of the first or second interlock members causes corresponding movement of the other one of the first or second interlock members.

The present invention may also be embodied in an electrical panel that has a pair of aligned transfer switches including a first switch member operable to selectively interrupt electrical connection to a first neutral conductor and a second switch member operable to selectively interrupt electrical connection to a second neutral conductor. The first switch member is designed to interrupt electrical connection to the first neutral conductor when the first switch member is switched away from the second switch member and the second switch member is designed to interrupt electrical connection to the second neutral conductor when the second switch member is switched away from the first switch member. The electrical panel further has an interlock arrangement operable with the pair of aligned transfer switches to prevent both the first switch member and the second switch member from being switched toward one another at the same time. The interlock arrangement includes a first planar member slidable with the first switch member and a second planar member slidable with the second switch member. The planar members are positioned generally adjacent to one another such that movement of one planar member towards the other planar member causes the other planar member to move away from the one planar member.

Various other features, objects and advantages of the present invention will be made apparent from the following detailed description of the drawing figures.

BRIEF DESCRIPTION OF THE DRAWINGS

The drawings illustrate one preferred embodiment presently contemplated for carrying out the present invention.

In the drawings:

FIG. 11 is an elevational view of the load center assembly shown in FIG. 10 with the switches and interlock assembly positioned such that alternate power is communicated to the load terminal bars and the utility neutral OFF and the alternate power supply neutral ON;

DETAILED DESCRIPTION OF THE PREFERRED EMBODIMENT

Figure 1:
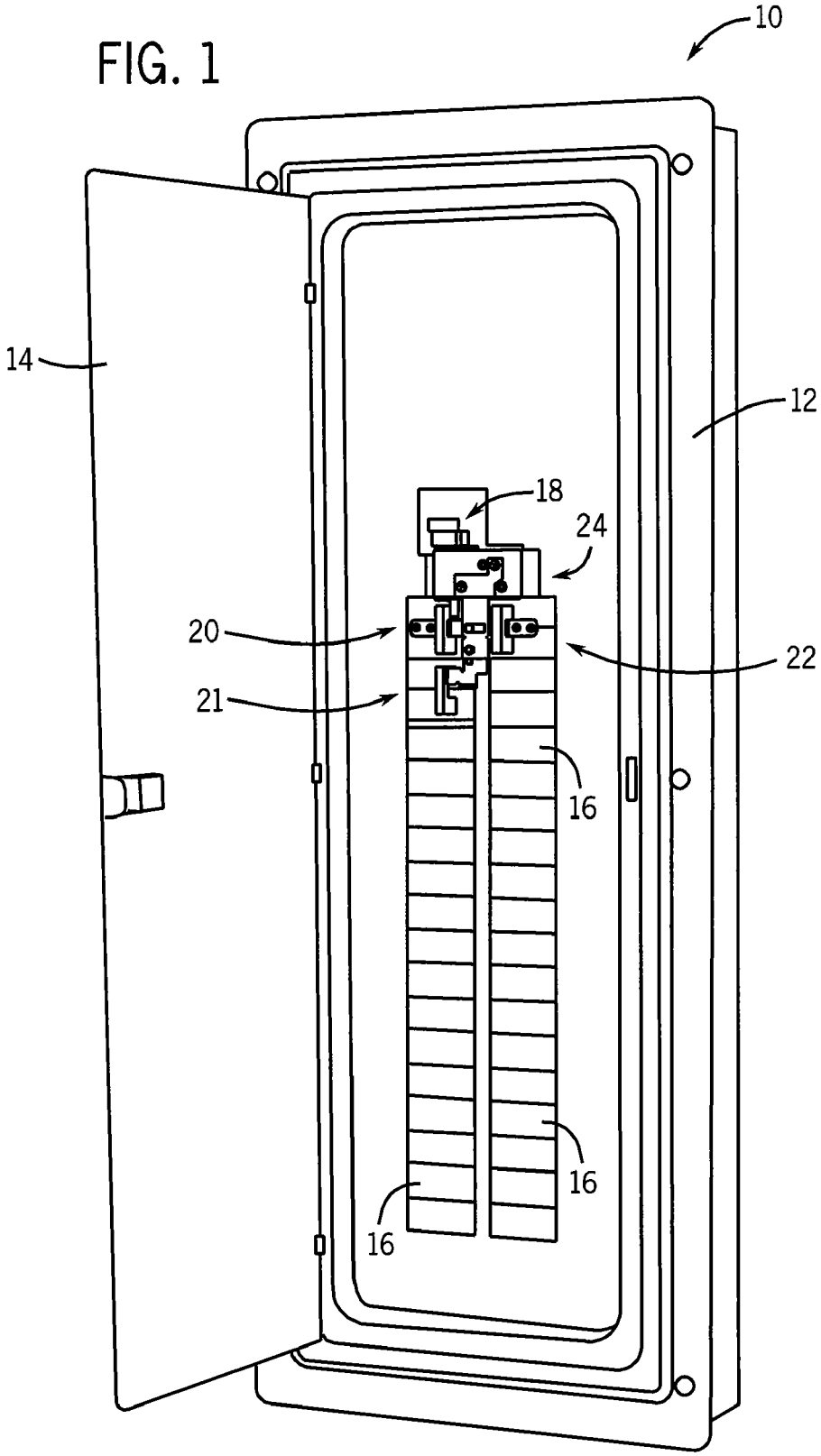
FIG. 1 is a perspective view of an exemplary load center assembly having one embodiment of an interlock assembly according to the present invention.

FIG. 1 shows a load center assembly 10 according to one embodiment of the present invention, which is configured to supply power to a series of electrical circuits from one of at least two power sources. Representatively, load center assembly 10 controls the supply of power to the electrical circuits from a primary power supply, such as utility power, and an alternate or secondary power source which is adapted to supply power in the event power from the primary power supply is unavailable. Typically, the alternate or secondary power source is an electrical generator, although it is understood that any other source of secondary or alternate power may be employed. The following description utilizes terminology which makes reference in various instances to a generator, and it is understood that such terminology is used for the sake the convenience and that the term "generator" is meant to encompass any secondary or alternate power source, and is not limited to a generator as the alternate power source.

Load center assembly 10 includes a cover 12 having a door 14 pivotably connected thereto. Cover 12 includes a series of knockouts 16 constructed to be removed as load breakers are added to load center assembly 10. A main switch 18 passes through cover 12 and is constructed to be connected to a utility power input. A generator neutral switch 20, generator switch 21, and a utility neutral switch 22 are constructed to be electrically connected to load center assembly 10. An interlock assembly 24 is connected to load center assembly 10 and prevents the inadvertent connection of the utility power input via main switch 18 and generator power input via generator switch 21 from being concurrently connected to a the load terminals of load center assembly 10. As will be explained, interlock assembly 24 also controls the movement of neutral switches 20 and 22 relative to main switch 18 and generator switch 21, to ensure that the switches are actuated in the correct sequence.

Figure 2:
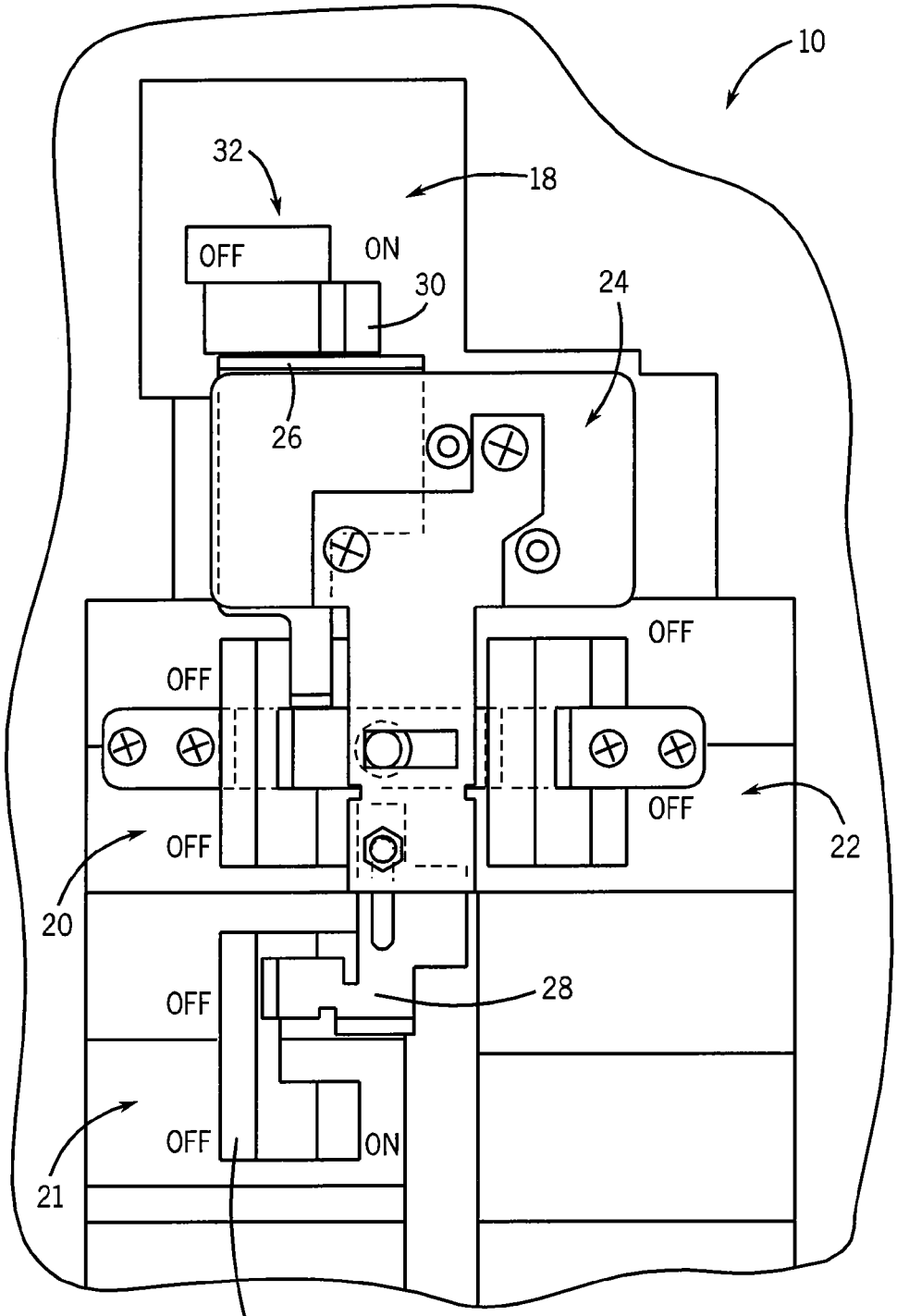
FIG. 2 is an elevational view of the load center assembly shown in FIG. 1 with the interlock assembly configured to enable the supply of utility power to the loads interconnected with the load center assembly.

FIG. 2 shows load center assembly 10 with interlock assembly 24 configured to enable the supply of utility power via main switch 18 such that the loads connected to load center assembly 10 are powered by utility power. Interlock assembly 24 is positioned to prevent the connection of generator power communicated via generator switch 21 to the load terminal bars of load center assembly 10, by preventing movement of generator switch 21 to the ON position. Interlock assembly 24 includes a first movable interlock 26 and a second movable interlock 28, the operation of which are described in FIGS. 2 through 7.

Figure 3:
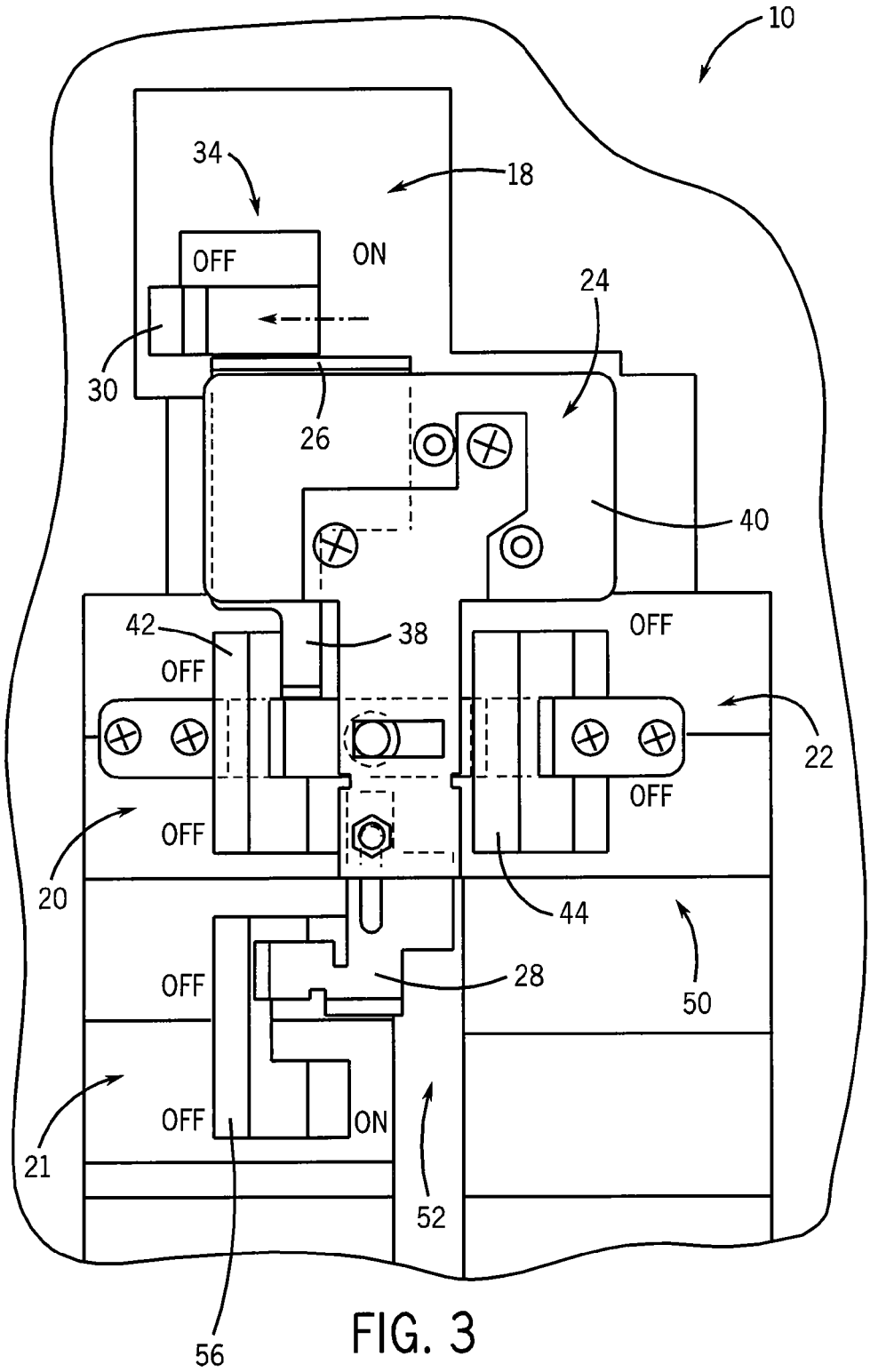
FIG. 3 is an elevational view of the load center assembly shown in FIG. 2 with the utility power and alternate power disconnected from the loads interconnected with the load center assembly.

Referring to FIG. 3, during interruption of utility power, a user translates switch handle 30 of main switch 18 from an ON position 32, as shown in FIG. 2, to the OFF position 34, as shown in FIG. 3. Such manipulation electrically isolates the load terminals and generator switch 21 from utility power conductors connected to main switch 18. With switch 18 positioned in OFF position 34, movable interlock 26 is manually translated upwardly in the direction of arrow 36 (shown in FIG. 4), thereby preventing movement of handle 30 away from the OFF position 34 and locking handle 30 OFF (shown in FIG. 4). A tab 38 of interlock 26 also moves in direction 36 and passes behind an interlock assembly retainer plate 40. Prior to movement of interlock 26 in direction 36, tab 38 extends into the throw of a switch handle 42 of generator neutral switch 20. Accordingly, prior to movement of interlock 26 in direction 36, tab 38 prevents the movement of generator neutral switch 20 away from the generator neutral OFF position. Because generator neutral switch handle 42 and the switch handle 44 of utility neutral switch 22 are interconnected for linear movement together by an inline interlock assembly 46, tab 38 also prevents the movement of utility neutral switch 22 away from the utility neutral ON position.

Figure 4:
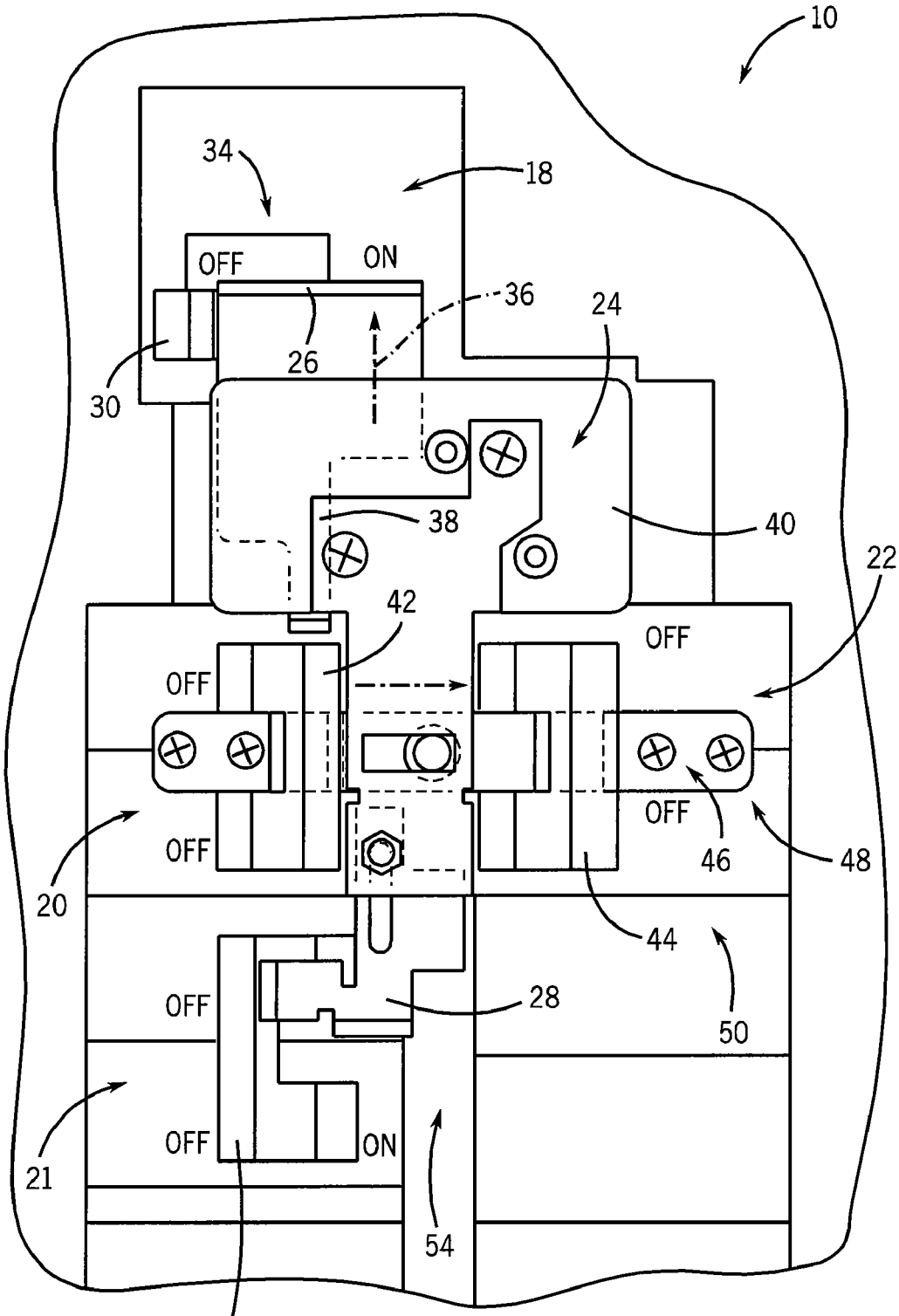
FIG. 4 is an elevational view of the load center assembly shown in FIG. 3 with the interlock assembly configured to enable a pair of neutral switches to switch OFF the utility neutral and switch ON the generator neutral.

As shown in FIG. 4, translation of interlock 26 in direction 36 relative to interlock assembly plate 40 obstructs handle 30 of main switch 18, thereby preventing utility power from being communicated to the load terminal bars of load center assembly 10. At the same time, tab 38 translates in direction 36 behind interlock assembly plate 40 and out of the way of the throw of handle 42 of generator neutral switch 20. Accordingly, when handle 30 of main switch 18 is located in OFF position 34, generator neutral switch 20 can be moved to the ON position by translation of handle 42. Due to the presence of inline interlock assembly 46 between switch handle 42 and switch handle 44 of generator neutral switch 20 and utility neutral switch 22, respectively, generator neutral switch 20 is operable to an ON position and utility neutral switch 22 is moved to an OFF position, represented as position 48 as shown in FIG. 4. This connects the generator neutral to a neutral bar of load center assembly 10 common to switches 20 and 22.

Representatively, inline interlock assembly 46 may have a construction as is shown and described in Flegel U.S. Pat. No. 6,031,193 issued Feb. 29, 2000 or Flegel U.S. Pat. No. 6,927,349 issued Aug. 9, 2005, the entire disclosures of which are hereby incorporated by reference.

Figure 5:
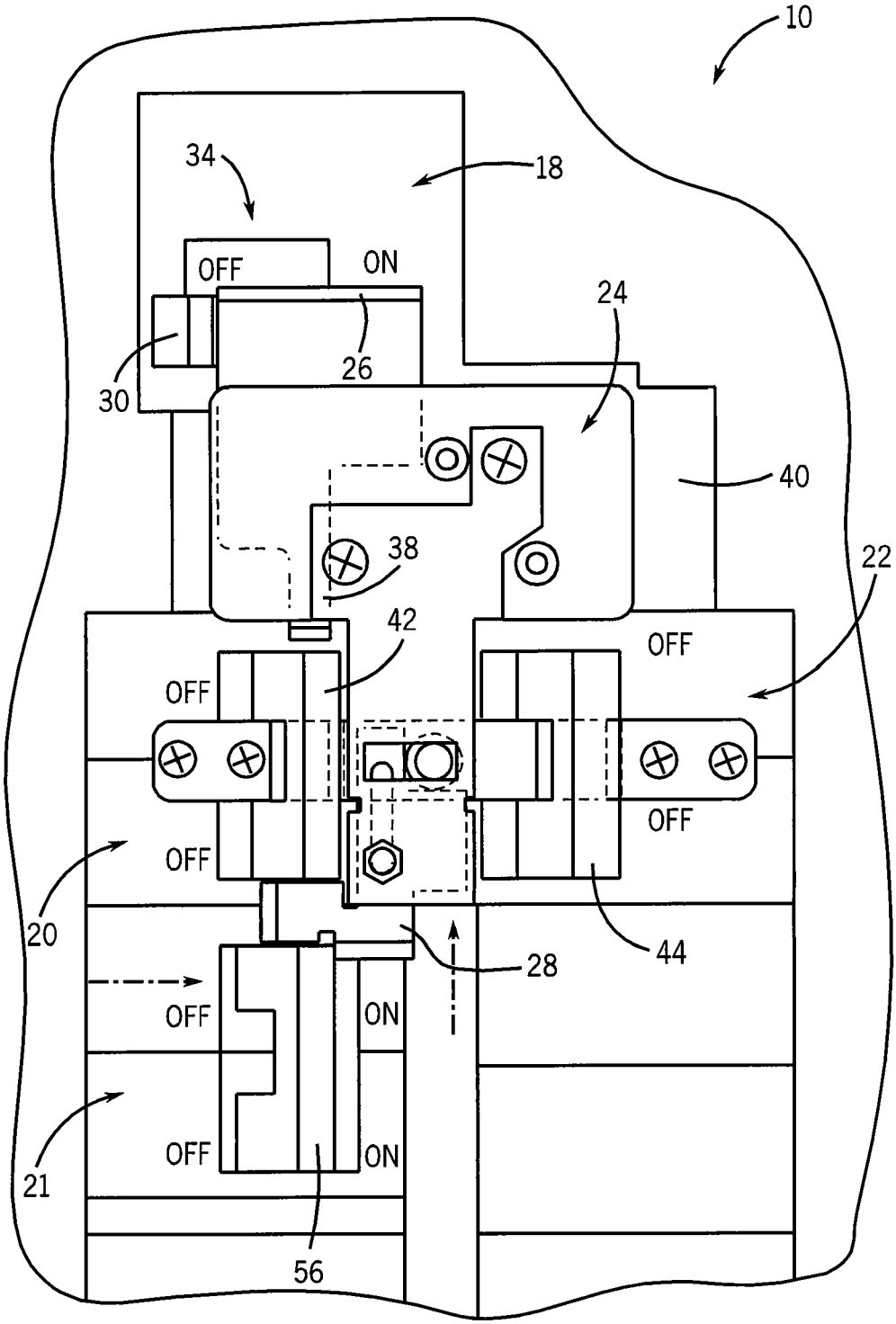
FIG. 5 is an elevational view of the load center assembly of FIG. 4 showing movement of a switch associated with the alternate power input connected to the loads interconnected with the load center assembly.

Referring to FIG. 3 and FIG. 4, second interlock 28 is movable from a first position 52, as shown in FIG. 3, to a second position 54, as shown in FIG. 4, when generator neutral switch handle 42 is in the ON position and utility neutral switch handle 44 is in the OFF position. As shown in FIG. 3, when second interlock 28 is located in first position 52, interlock 28 obstructs the operation of a switch handle 56 of generator switch 21. Also, interlock 28 is prevented from moving by a post 55 of interlock assembly 46. When second interlock 28 is allowed to be moved to second position 54 by the change in position of interlock assembly 46, as shown in FIG. 4, a switch handle 56 of generator switch 21 is operable to connect the generator power input to the input of load center assembly 10. Accordingly, when switch handles 30, 42, 44, and 56 are oriented in the positions as shown in FIG. 5, load center assembly 10 is electrically connected to a generator power input and electrically isolated from a utility power input, and the generator neutral is connected to the neutral of load center assembly 10. Furthermore, interlock assembly 24 prevents the reconfiguration of switches 18, 20, 22, and 21 to such an orientation wherein generator power and utility power are concurrently delivered to the load terminal bars of load center assembly 10. As such, interlock assembly 24 is constructed to sequence the operation of switches 18, 20, 22, and 21 and thereby control and segregate the input power delivered to the load terminal bars of load center assembly 10 relative to the neutral connections of the utility and generator power supplies.

Figure 6:
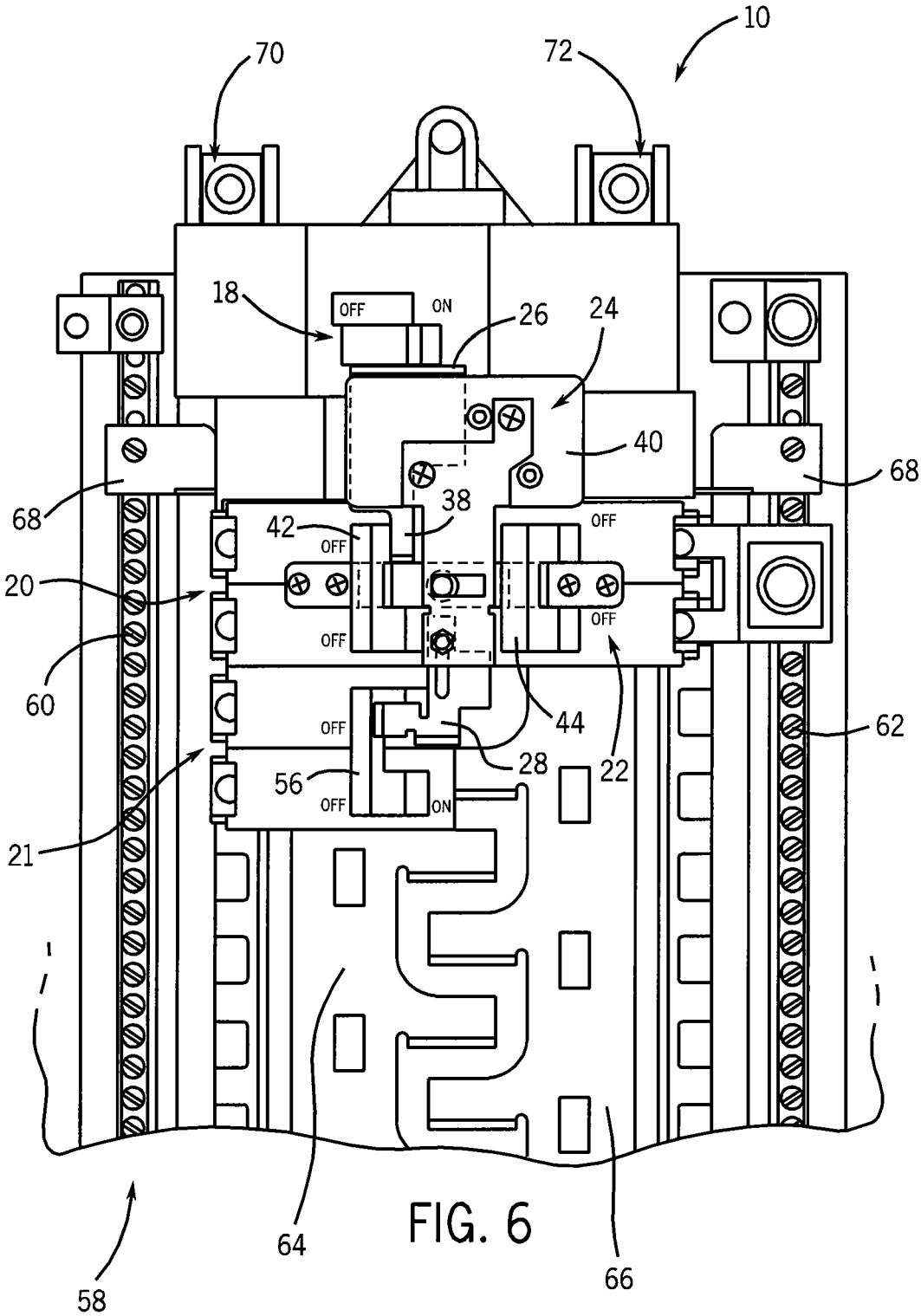
FIG. 6 shows the load center assembly of FIG. 1 with the cover removed therefrom.

As shown in FIG. 6, removal of cover 12 from load center assembly 10 exposes a series of terminal bars 58 located behind the cover 12. Terminal bars 58 include a first and a second neutral bar 60, 62 and a first and a second hot lead terminal bar 64, 66, respectively. A neutral connector plate 68 extends behind interlock assembly 24 and electrically connects first neutral bar 60 and second neutral bar 62. Generator neutral switch 20 is electrically connected to neutral connector plate 68, as is utility neutral switch 22. Generator switch 21 is electrically connected to hot terminal bars 64 and 66.

Figure 7:
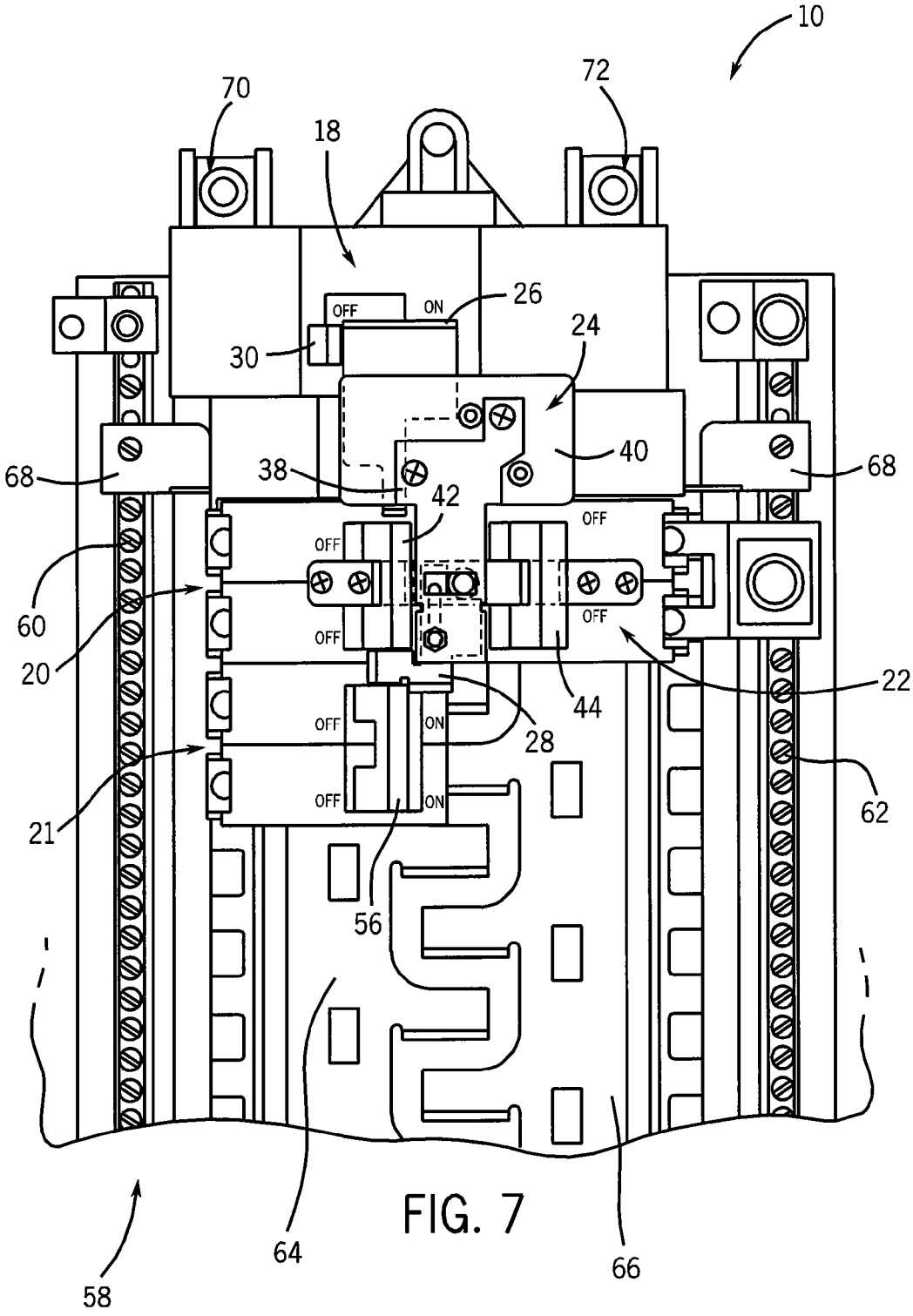
FIG. 7 shows the load center assembly of FIG. 1 with the switches positioned such that utility power is isolated from the load terminal bars and power from the alternate power supply is connected thereto.

Main switch 18 includes a first input terminal 70 and a second input terminal 72 constructed to be electrically connected to a utility power conductor connected to load center assembly 10. When switch handle 30 of main switch 18 is positioned in an ON position, as shown in FIG. 6, utility power communicated to input terminal 70 and input terminal 72 is communicated through main switch 18 to hot terminal bar 64 and hot terminal bar 66, thereby communicating utility power to the load breakers connected to load center assembly 10. Referring to FIG. 7, switch handle 30 of main switch 18 is moved to an OFF position, thereby electrically isolating input terminal 70 and input terminal 72 of main switch 18 from hot terminal bars 64, 66. Movement of first interlock 26 of interlock assembly 24 prevents switch handle 30 from being moved to an ON position and translates tab 38 of interlock assembly 24 such that switch handle 42 of generator neutral switch 20 is free to be moved to an ON position, which also results in movement of switch handle 44 of utility neutral switch 22 to an OFF position. Translation of second interlock 28 relative to interlock assembly 46 allows switch handle 56 of generator switch 21 to be moved to an ON position. In this manner, generator switch 21 is connected to hot terminal bars 64 and 66 and the generator neutral switch 20 is connected to neutral bars 60 and 62 via neutral connector plate 68. Accordingly, when switch handles 30, 42, 44, and 56 are oriented in the positions shown in FIG. 7, generator power is communicated through generator switch 21 to hot terminal bars 64, 66 and generator neutral is communicated through generator neutral switch 20 to neutral plate 68, thereby electrically connecting loads connected to either of first hot terminal bar 64 or second hot terminal bar 66 to the generator-provided input power associated with generator switch 21. This also isolates utility neutral from generator neutral and thus, the neutrals cannot be switched back unless generator and utility supply switches are both OFF. Generator power delivered to load center assembly 10 and communicated to hot terminal bar 64 and hot terminal bar 66 is electrically isolated from utility input terminals 70, 72 of main switch 18. Interlock assembly 24 prevents the concurrent electrical connection of generator switch 21 and main switch 18 with hot terminal bars 64, 66. Such a construction electrically isolates utility input terminals 70 and 72 from hot terminal bars 64, 66 when generator power is supplied, thereby preventing communication of generator-derived power beyond load center assembly 10 via utility conductors connected thereto.

Figure 8:
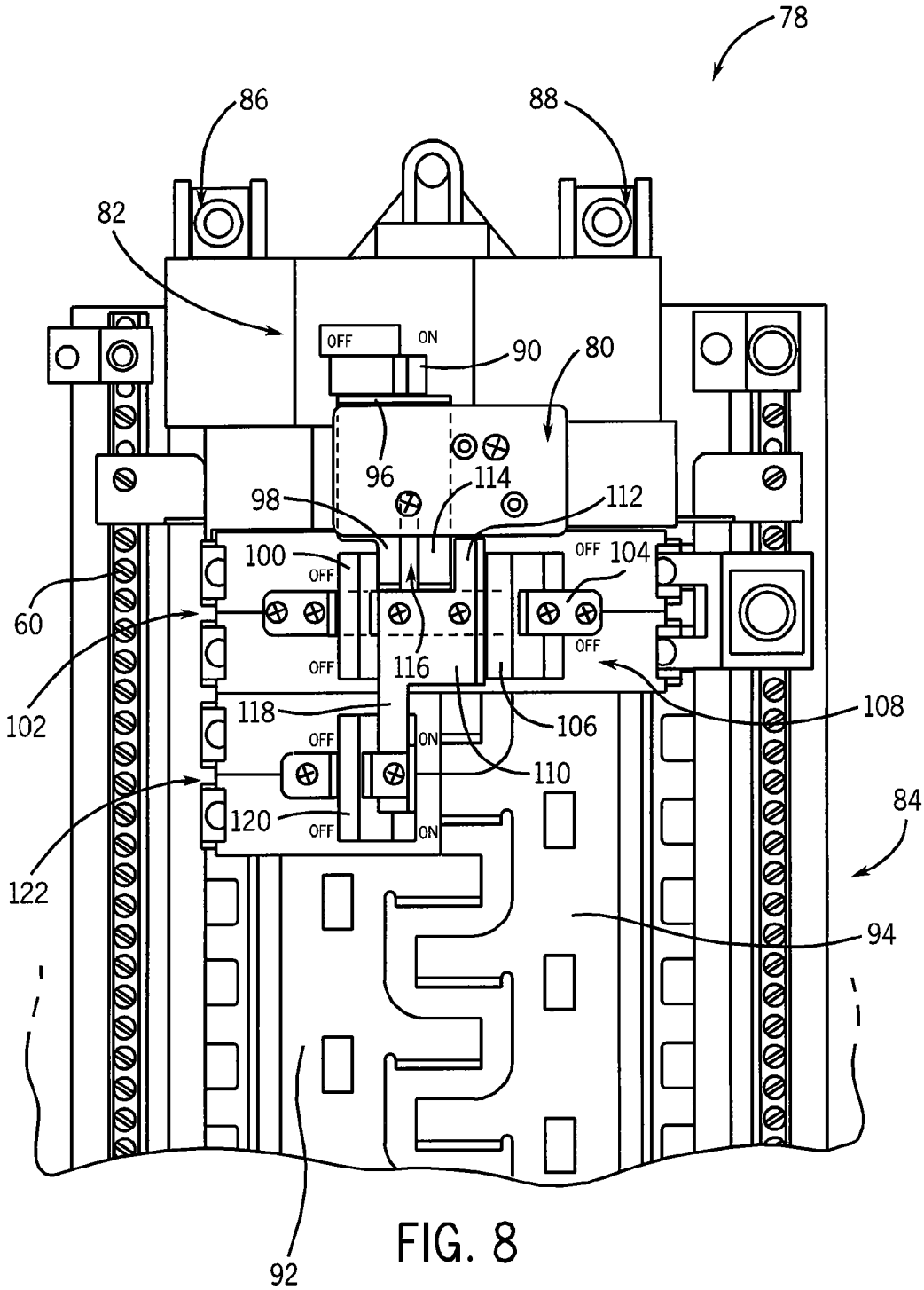
FIG. 8 is an elevational view of a load center assembly equipped with another embodiment of an interlock assembly according to the invention.

FIG. 8 shows another breaker box assembly or load center 78 according to another embodiment of the present invention. Load center 78 includes an alternate embodiment of an interlock assembly 80 according to the present invention. Interlock assembly 80 is disposed between a utility or main switch 82 and a series of switches mounted to load center 78. Main switch 82 includes a first input terminal 86 and a second input terminal 88 constructed to be electrically connected to utility power conductors, respectively. A switch 82 electrically connects input terminals 86, 88 with hot terminal bars 92, 94. Interlock assembly 80 includes a movable interlock 96 that has a tab 98 extending therefrom. Tab 98 extends into a throw of a switch handle 100 of generator neutral switch 102, thereby preventing movement of generator neutral switch handle 100 when tab 98 is so positioned.

An inline interlock assembly 104 extends between generator neutral switch handle 100 and a switch handle 106 of a utility neutral switch 108 such that generator neutral switch handle 100 and utility neutral switch handle 106 are operatively associated such that neither switch can be independently moved. A bracket 110 is connected to connector assembly 104 and disposed between switch handle 100 and switch handle 106. Bracket 110 includes a first extension 112, which interferingly engages another tab 114 of interlock 96. First extension 112 and tab 114 are associated to allow movement of interlock 96 into a space 116 formed between first extension 112 and switch handle 100 of generator neutral switch 102. Such an orientation ensures a snug engagement therebetween, thereby preventing movement of switch handle 100 or switch handle 106 relative to interlock 96 when tabs 98, 114 are disposed in space 116.

Bracket 110 includes a second extension 118, which extends in a direction generally opposite the direction of extension of first extension 112. Second extension 118 is operatively connected to a switch handle 120 of a generator switch 122. Generator switch 122 is electrically connected to hot terminal bars 92, 94. Neutral switches 102 and 108 are electrically connected to neutral bar 60 and 62 via neutral connector plate 68. Accordingly, regardless of which side of load center 78 load circuits are connected, generator power can be utilized to power any desired load connected to load center 78.

Figure 9:
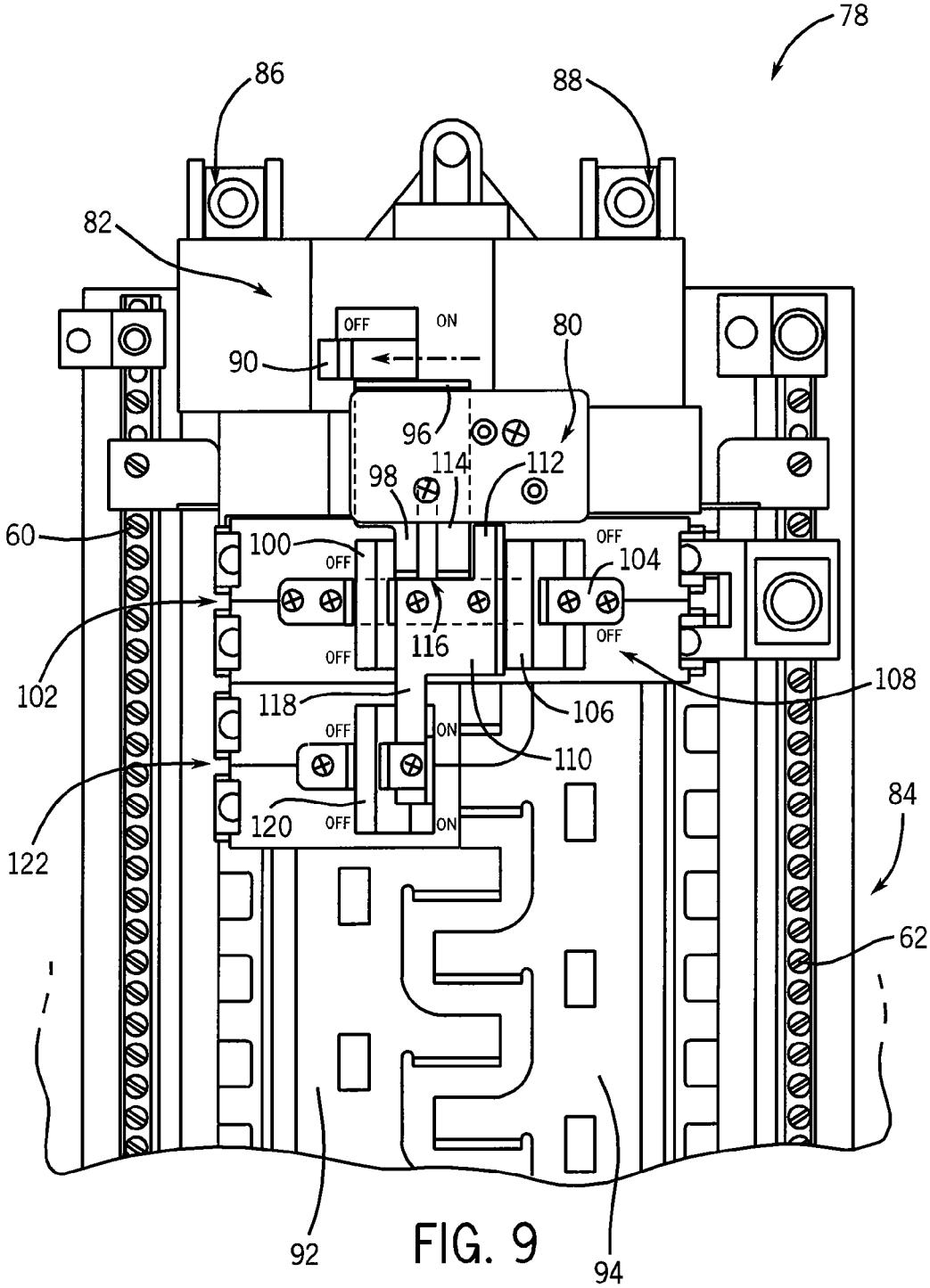
FIG. 9 is an elevational view of the load center assembly shown in FIG. 8 with the switches positioned such that utility power and power from the alternate power supply are both isolated from the load terminal bars and the utility neutral ON and the alternate power supply neutral OFF.

As shown in FIG. 9, switch handle 90 of main switch 82 is located in an OFF position, thereby electrically isolating hot terminal bars 92, 94 from the utility power connected to input terminals 86 and 88 of load center 78. Positioning of switch handle 90 in the OFF position allows interlock 96 to be moved in a direction, indicated by arrow 124 (shown in FIG. 10), toward switch handle 90. As interlock 96 moves in direction 124, tabs 98, 114 translate therewith and out of interfering engagement with switch handles 100, 106 and 120.

Figure 10:
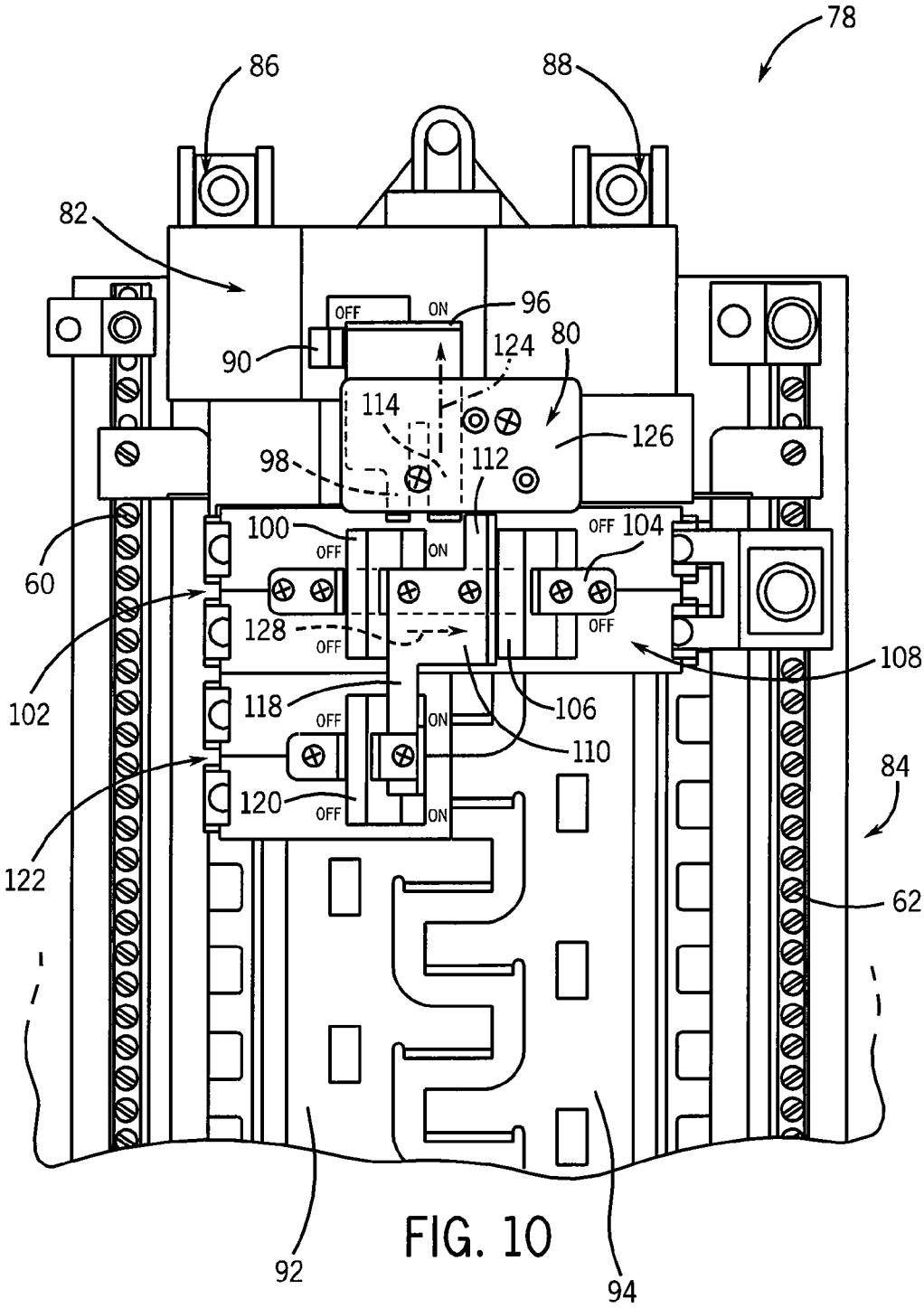
FIG. 10 is an elevational view of the load center assembly shown in FIG. 9 with the switches and interlock assembly configured to prevent connection of utility power to the load terminal bars and allow connection of alternate power thereto.

As shown in FIG. 10, when switch handle 90 is located in an OFF position and interlock 96 is displaced in direction 124, interlock 96 prevents switch handle 90 from being moved to the ON position. Accordingly, when interlock 96 is oriented in the position shown in FIG. 10, switch 82 is configured to electrically isolate the utility power input terminals 86, 88 from hot terminal bars 92, 94, thereby electrically isolating utility conductors connected to inputs 86, 88 from generator power communicated to hot terminal bars 92, 94. Furthermore, as shown in FIG. 10, when interlock 96 is positioned to obstruct handle 90, tabs 98, 114 translate in direction 124 and pass behind a cover plate 126 of interlock assembly 80. Switches handles 100, 106, 120 are interconnected via bracket 110 such that, when interlock 96 is translated in direction 124, as shown in FIG. 10, movement of any of switch handles 100, 106, 120 in a transverse direction, indicated by arrow 128, electrically connects generator input power from generator switch 122 to hot terminal bars 92, 94, respectively, and connects the generator neutral switch 102 to neutral bar 60. The connection of generator switch handle 120 to bracket 110 is positioned such that, as bracket 110 is translated laterally, the utility neutral switch handle 106 is first moved OFF and the generator neutral switch handle 100 is moved ON, before generator switch handle 120 is moved ON. Similarly, the generator switch handle is turned OFF before the generator neutral is switched OFF. This ensures proper sequence of operation of the switches as the supply of power from utility to generator is transferred.

Figure 11:
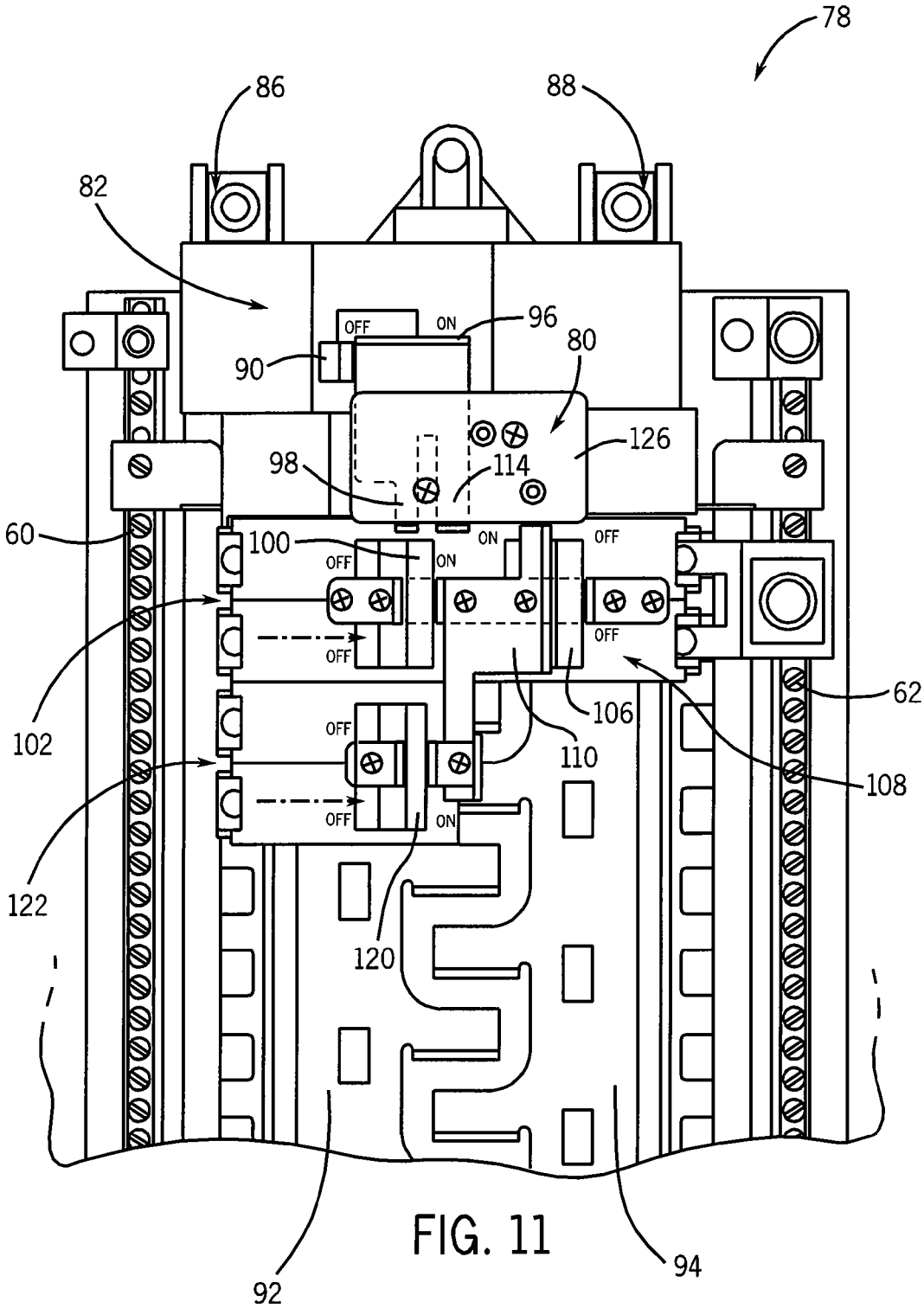

As shown in FIG. 11, bracket 110 has been translated in direction 128, thereby moving switch handles 100, 106, 120 to an ON position, and electrically connecting generator power communicated to generator switch 122 to hot terminal bars 92, 94 and connecting generator neutral switch 102 to neutral bars 60, 62. Furthermore, when generator power is communicated through generator switches 122 to hot terminal bars 92, 94, movable interlock 96 of interlock assembly 80 prevents the electrical connection of utility power input terminals 86, 88 of utility switch 82 with hot terminal bars 92, 94, thereby electrically isolating input terminals 86 and 88 from power communicated to load center 78 via the utility power source. Understandably, to convert load center 78 from utility-derived power to generator-derived power, a user must simply orient handle 90 of main switch 82 in the OFF position, translate interlock 96 in direction 124, and translate switch handles 100 and 120 to an ON position, thereby electrically connecting the generator-type power to hot terminal bars 92, 94 and the neutral to neutral bars 60, 62. Such a configuration allows a user to conveniently and expeditiously configure load center 78 to power desired loads from a desired input power supply.

Figure 12:
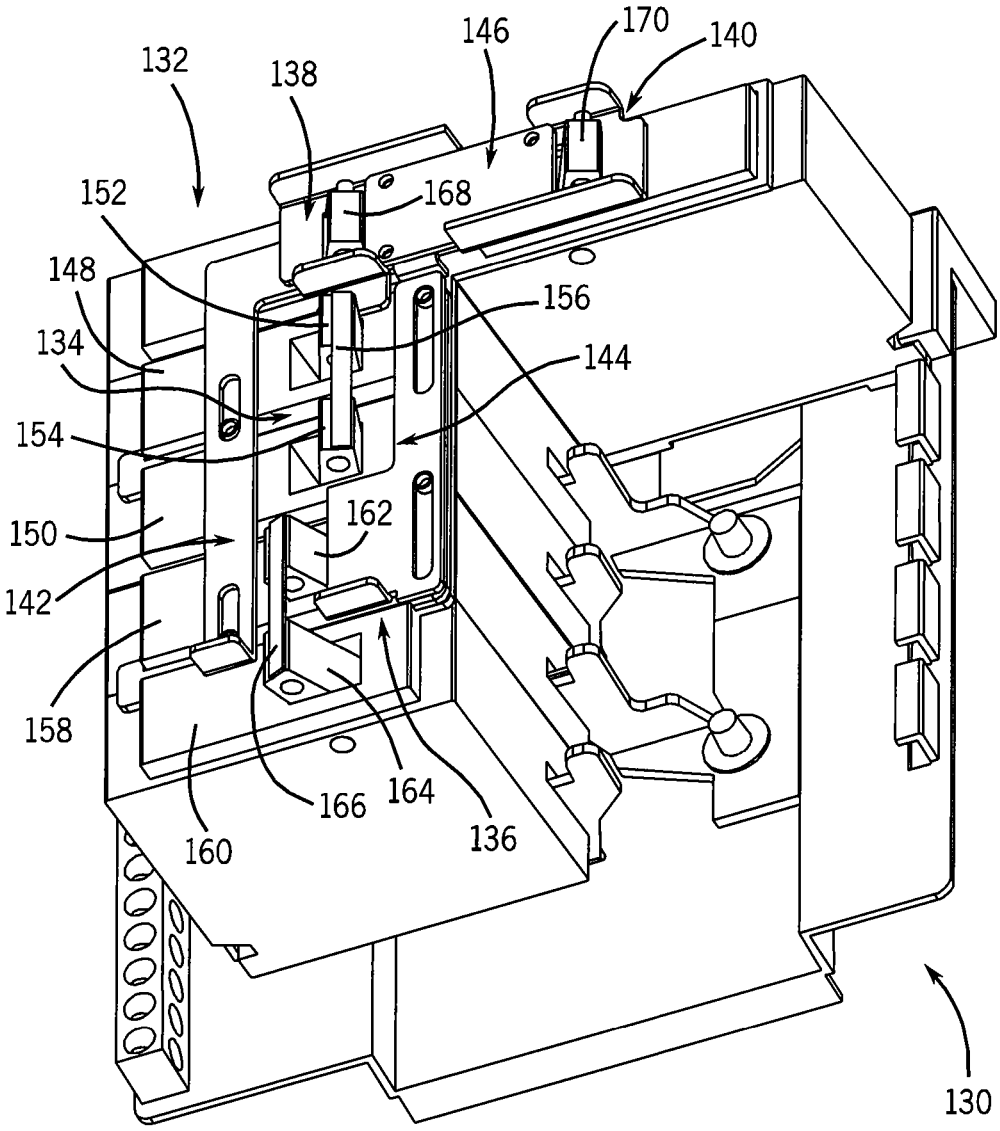
FIG. 12 is an isometric view of an interlock assembly for use with a transfer switch designed to control connection of a load center to a utility power supply and an alternate power supply according to another embodiment of the invention.
Figure 13:
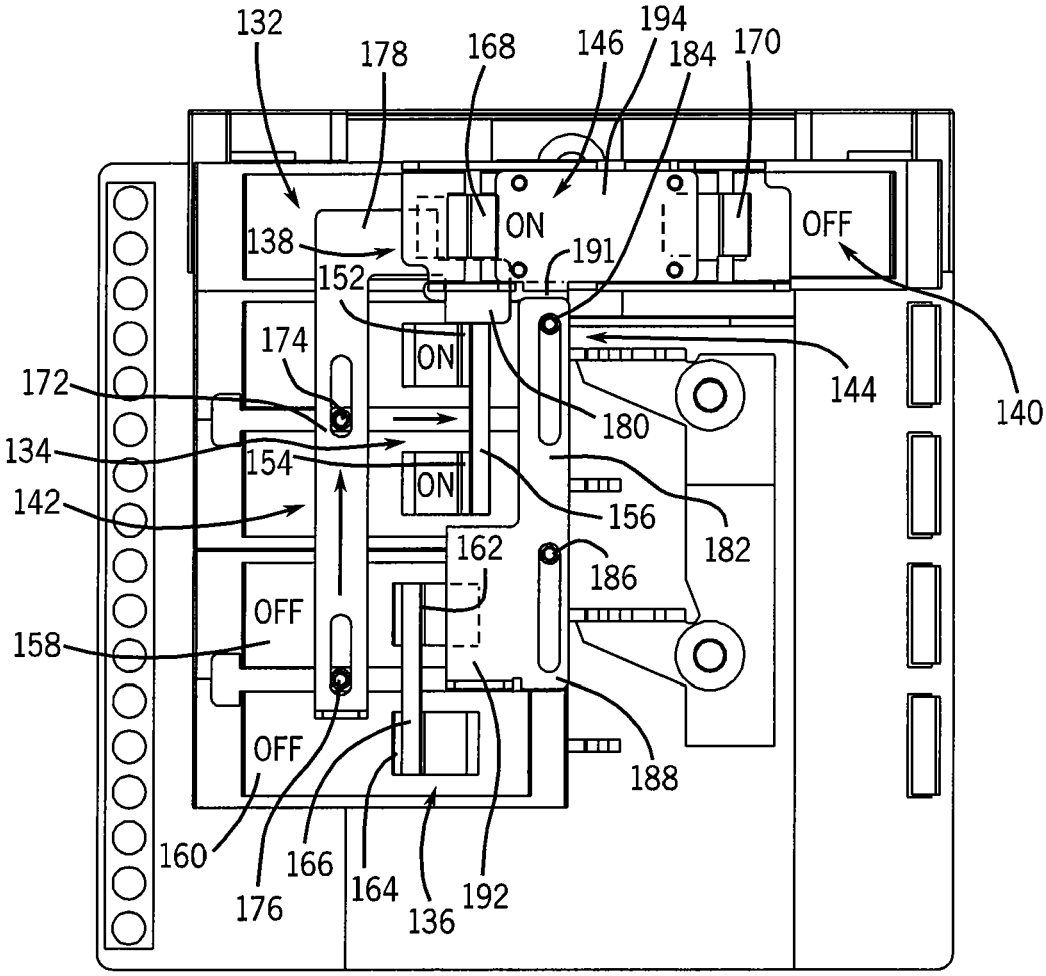
FIG. 13 is an elevation view of the interlock assembly of FIG. 12 positioned such that utility power may be communicated to the load center.

FIGS. 12-16 illustrate an interlock assembly according to another embodiment of the invention. Like the interlock assembly described with respect to FIGS. 1-11, interlock assembly is designed to prevent a load center assembly from being electrically connected to receive power from two power supplies simultaneously. FIGS. 12-13 show a portion of a load center assembly 130 with interlock assembly 132 configured to enable the supply of utility power via utility switch 134 such that the loads of the load center assembly 130 are powered by utility power. Interlock assembly 132 is positioned to prevent the connection of generator power communicated via generator switch 136 to the load center assembly 130, by preventing movement of generator switch 136 to the ON position. The interlock assembly 132 also interfaces with utility neutral switch 138 and alternate power neutral switch 140 to prevent both switches 138, 140 from being in the ON position simultaneously. The neutral switches 138, 140 are aligned with one another with a switch being in the ON position when thrown toward the other switch. Thus, in FIGS. 12-13, the utility neutral switch 138 is in the ON position and the alternate power neutral switch 140 in the OFF position. As will be described more fully below, the interlock assembly 132 includes a first movable interlock 142, a second movable interlock 144, and an inline neutral interlock 146.

The utility switch 134 is comprised of a pair of breakers 148, 150, each having switch handles 152, 154, respectively, which are tied together in a known manner by member 156. Similarly, the alternate power switch 136 is comprised of a pair of breakers 158, 160, each having switch handles 162, 164, respectively, which are tied together in a known manner by member 166. Neutral switches 138 and 140 similarly include respective switch handles 168 and 170. FIG. 12 shows the arrangement of the interlock assembly 132 as well as the switches 134, 136, 138, and 140 when the load center is operative to receive power from the primary power supply, e.g., utility grid, and is electrically isolated from the alternate power supply, e.g., electric generator.

Interlock 142 has a generally planar and slotted body 172 designed to slide along pins 174, 176. The body 172 has an upper portion 178 from which a leg member 180 downwardly extends. As shown in FIG. 13, the leg 180 is spaced from the slotted body 172. The upper portion 178 as well as the leg 180 are located below a portion of the inline interlock 146. Interlock 144 also has a planar and slotted body 182 that is designed to slide along pins 184, 186. The body 182 is has a lower portion 188 from which a leg 190 axially extends and an upper portion 191. As will be described more fully below, when the body 182 is slid fully upward, a portion of the body 182 will slide beneath the inline interlock 146. The inline interlock 146 is generally comprised of a plate 194 that abuts against both switch handles 168 and 170, and is designed to slide with movement of the switch handles 168, 170. Interlocks 142 and 144 slide independently of one another but along generally parallel axes.

Figure 14:
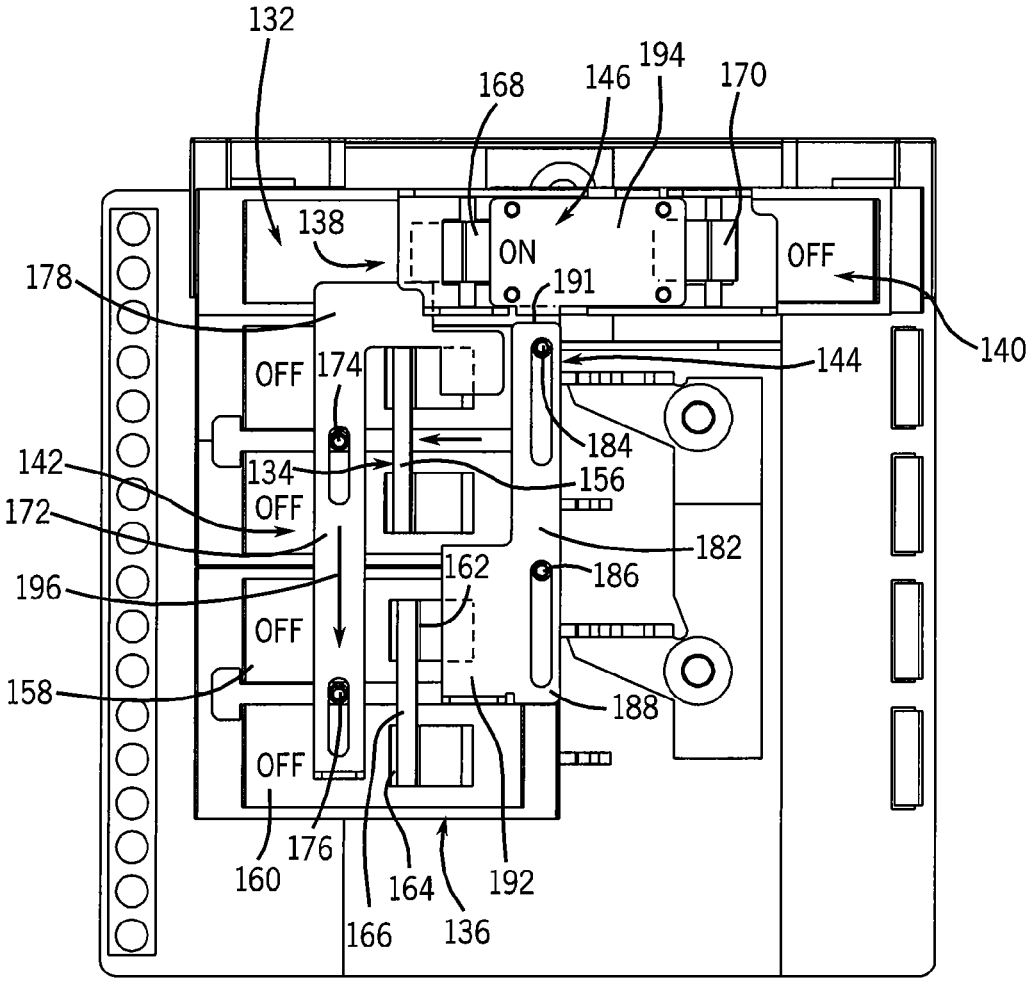
FIG. 14 is an elevation view of the interlock assembly of FIG. 12 positioned such that the utility power supply and the alternate power supply are both isolated from the load center.

During interruption of utility power, a user translates switch handles 152, 154 of switch 134 from an ON position, as shown in FIG. 13, to the OFF position, as shown in FIG. 14. With switch 134 positioned in the OFF position, movable interlock 142 is manually translated downward in the direction of arrow 196 (shown in FIG. 14). Leg 180 of interlock 142 thereby moves in direction 196 and passes behind switch handle 152. Prior to movement of interlock 142 in direction 196, upper portion 178 extends into the throw of switch handle 168 of utility neutral switch 138. Accordingly, prior to movement of interlock 142 in direction 196, upper portion 178 prevents the movement of utility neutral switch 138 away from the ON position. Because utility neutral switch handle 168 and the switch handle 170 of alternate power neutral switch 140 are interconnected for linear movement together by the inline interlock 146, upper portion 178 also prevents the movement of alternate power neutral switch 140 toward the alternate power neutral ON position. As shown in FIGS. 13-14, when the utility neutral switch 138 is in the ON position, the inline interlock 146 blocks upward movement of the movable interlock 144. It will also be appreciated that the utility and alternate power switches can both be OFF but cannot both be on at the same time.

Figure 15:
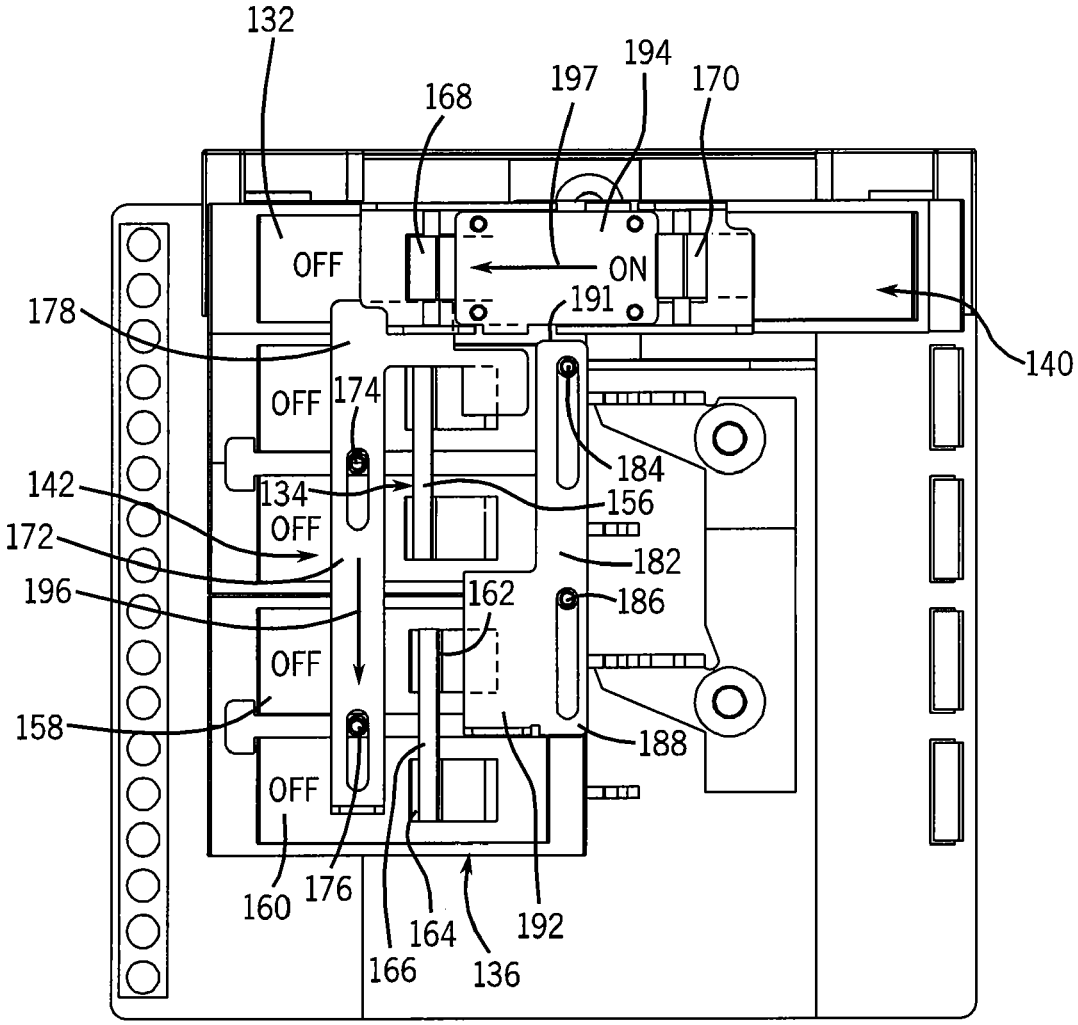
FIG. 15 is an elevation view of the interlock assembly of FIG. 12 positioned such that a utility neutral switch is in the OFF position and an alternate power supply neutral switch is in the ON position.

Referring now to FIG. 15, when the interlock 142 is moved downward in direction 196, the upper portion 178 of the interlock 142 is cleared from blocking movement of switch handle 168 of the utility neutral switch 138. In this regard, the neutral switch 138 can only be moved to its OFF position after the utility switch 134 has been moved to its OFF position. Additionally, because the neutral switches 138, 140 are linked together by inline interlock 146, the alternate power neutral switch 140 is automatically moved in direction 197 to its ON position when the utility neutral switch 138 is moved to its OFF position. Preferably, switch 138 reaches its OFF position before switch 140 reaches its ON position, such as described in U.S. Pat. No. 6,031,193 or U.S. Pat. No. 6,927,349, the disclosures of which are hereby incorporated by reference.

Figure 16:
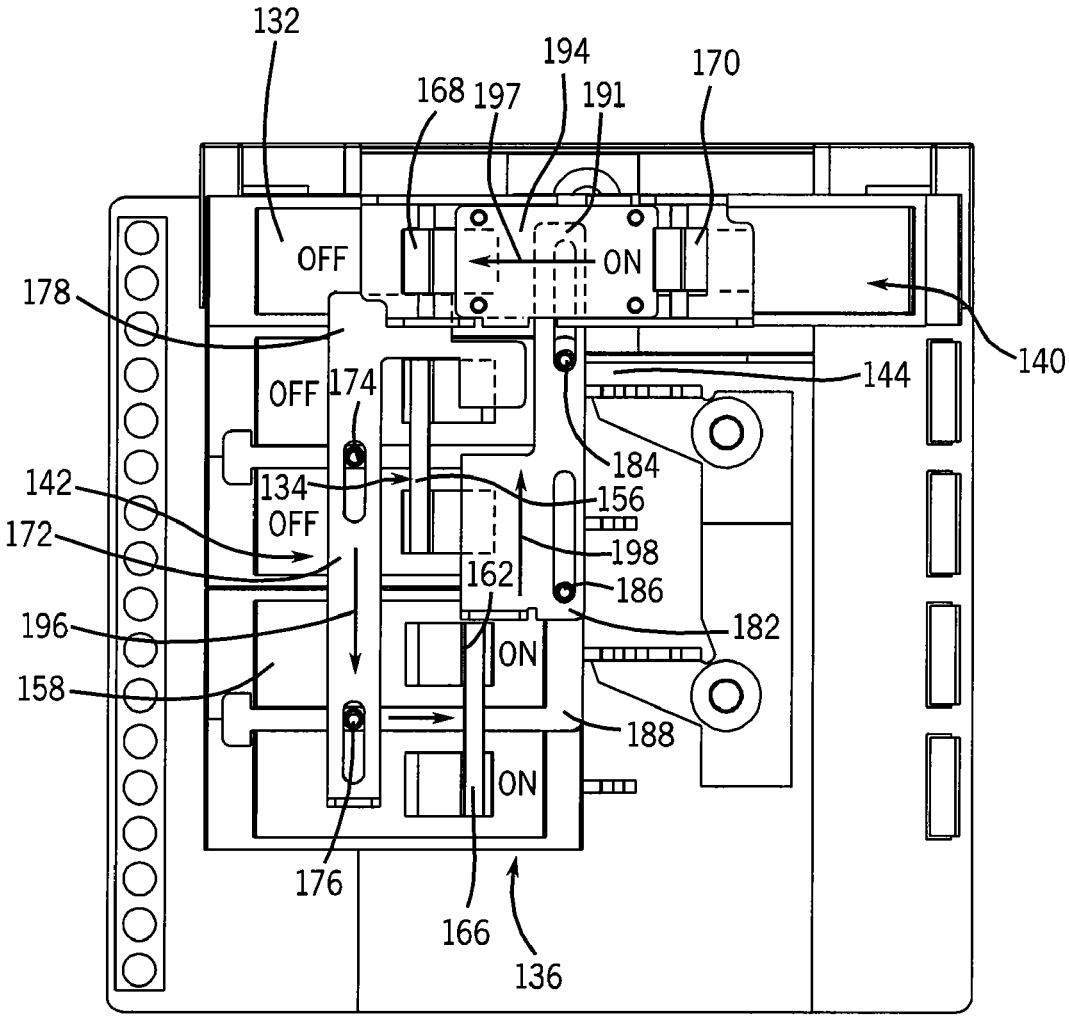
FIG. 16 is an elevation view of the interlock assembly of FIG. 12 positioned such that alternate power may be communicated to the load center.

When the utility neutral switch 138 is thrown to its OFF position, the plate 194 of the inline interlock follows that movement and, in effect, moves to a position whereby upward movement of the interlock 144 is no longer blocked by the inline interlock 146, as illustrated in FIG. 15. Thus, when the switch handles 152, 154 are thrown to the OFF position and the utility neutral switch 138 is moved to the OFF position, interlock 144 may be slid upwardly in direction 198 along pins 184, 186 to clear alternate power switch 136 as shown in FIG. 16. As also illustrated in FIG. 16, the upper portion 189 slides beneath the inline interlock 146 to free switch 136. In this position, interlock 144 prevents the inline interlock 146 from sliding and thus prevents the neutral switches 138, 140 from changing position and also blocks the utility switch 134 from being switched ON.

When the interlock 144 is slid upward in the direction represented by arrow 198, the switch handles 162, 164 of switch 136 may be thrown from the OFF position to the ON position. As a result, the load center assembly is now electrically isolated from the utility power supply and is connected to receive power from the alternate power supply. When utility power is restored, the switch sequence described above, is reversed to disconnect the load center assembly from the alternate power supply and connect it to the utility power supply.

It will thus be appreciated that the present invention provides an interlock assembly that sequences disconnection of the load center from a utility power supply and connection to an alternate power supply in a controlled manner to prevent the load center assembly from being electrically connected to both power supplies simultaneously.

Figure 17:
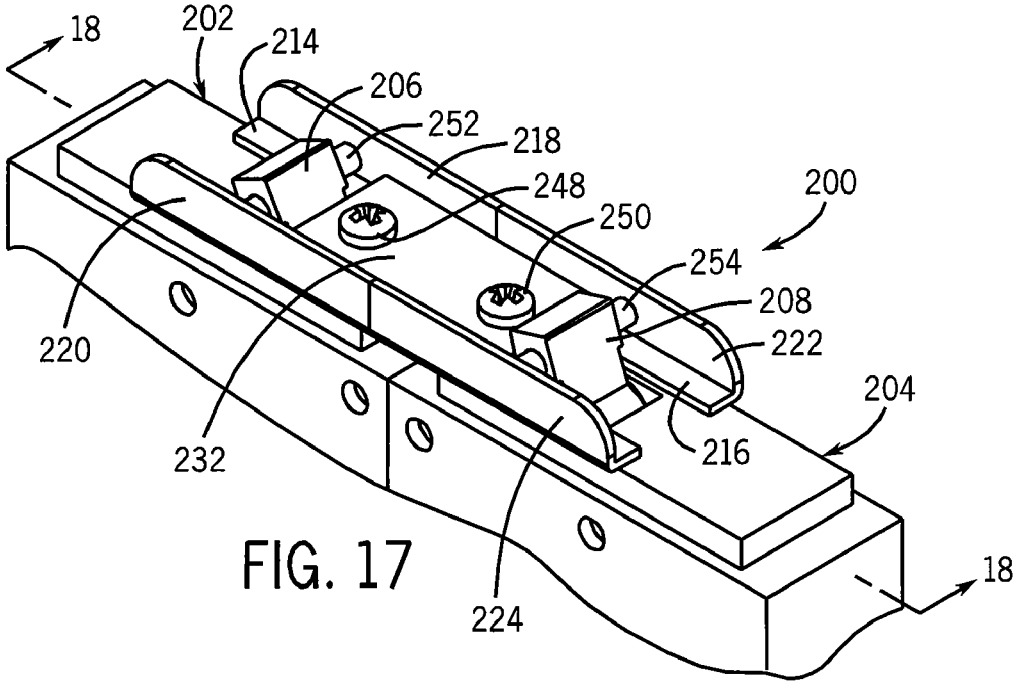
FIG. 17 is an isometric view of a neutral interlock assembly according to another aspect of the invention shown associated with a pair of aligned switches.

FIGS. 17-21 show interlock assemblies according to additional embodiments of the invention. More particularly, FIG. 17 shows an interlock assembly 200 designed to be associated with a pair of aligned switches 202, 204, which in the illustrated embodiment are neutral switches. Switch 202 has a switch member 206 that can be thrown between an ON position and an OFF position. Similarly, switch 204 has a switch member 208 that can also be thrown between an ON position and an OFF position. In the illustrated example, switch member 208 is in the ON position and switch member 206 is in the OFF position. Interlock assembly 200 is designed to prevent the switch members from being both being in the ON position at the same time.

Figure 18:
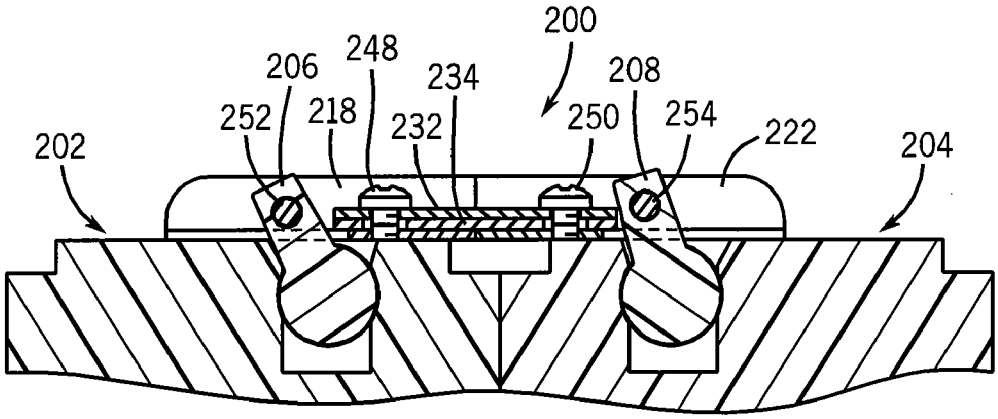
FIG. 18 is a section view of the neutral interlock assembly of FIG. 17 taken along line 18-18 of FIG. 17.
Figure 19:
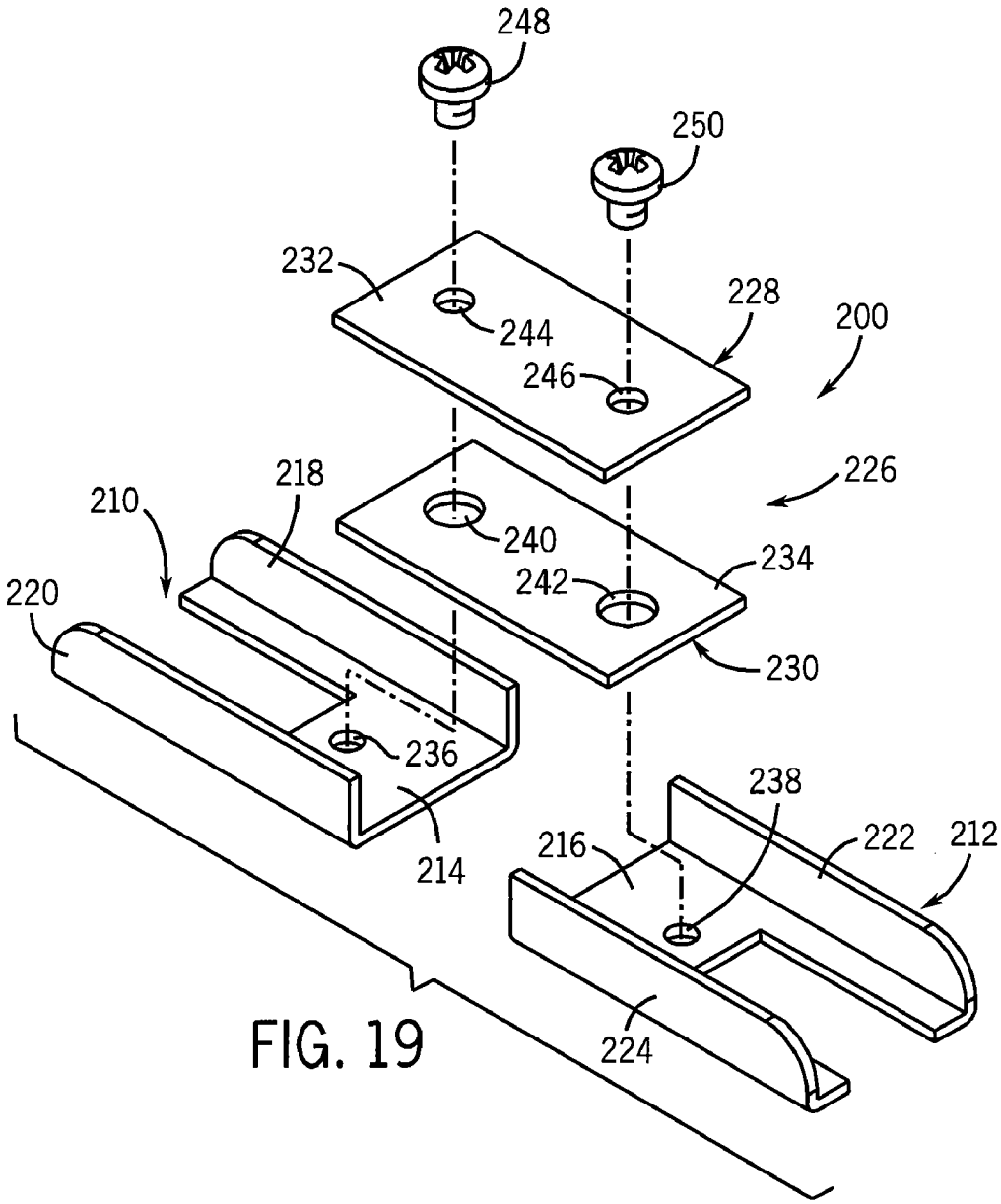
FIG. 19 is an exploded view of the neutral interlock assembly of FIG. 17.

With additional reference to FIGS. 18 and 19, the interlock assembly 200 is comprised of a pair of slidable members 210 and 212 associated with switches 202 and 204, respectively. Slidable members 210 and 212 are similar in their construction. Each member includes a planar base 214 and 216 that is notched to receive switch members 206 and 208, respectively. Slidable member 210 includes a pair of opposed upturned walls 218, 220 extending upwardly from opposed edges of the planar base 214. Similarly, slidable member includes a pair of opposed upturned walls 222, 224 extending upwardly from opposed edges of the planar base 216. In a preferred embodiment, the slidable members 210 and 212 are formed as single unitary members using a known fabrication technique. The planar bases 214 and 216 are designed to slide along the top surfaces (not numbered) of the switches 202 and 204, respectively, as will be described in greater detail below.

The slidable members 210 and 212 are joined together by a bridge assembly 226, which in the illustrated embodiment includes an upper bridge member 228 and a lower bridge member 230. Bridge member 228 comprises a generally rectangular plate 232. Similarly, bridge member 230 comprises a generally rectangular plate 234. The plates 232, 234 are generally of the same size and are vertically stacked when the interlock assembly 200 is assembled, as shown in FIG. 18.

Openings 236 and 238 formed in the planar bases 214 and 216, respectively, align with openings 240 and 242 of the lower bridge member 230 and openings 244 and 246 of the upper bridge member 228. Fasteners 248 and 250, which in one embodiment are machine screws, are used to couple the bridge members 228, 230 to the slidable members 210, 212. In this regard, the slidable members 210 and 212 move in tandem.

It will be appreciated that the stacked bridge members 228 and 230 are designed to engage the switch members 206 and 208 during a switching action. For example, in FIG. 18, switch member 208 is shown switched into the ON position, i.e., switched toward switch member 206. In this position, the switch member 208 abuts against the bridge plates 232, 234. On the other hand, switch member 206 is spaced from the bridge plates 232, 234. When the switch member 206 is switched from the OFF position to the ON position, it will engage the bridge plates 232, 234 thereby causing the bridge plates 232, 234, and the slidable members 210, 212 to slide toward the opposite switch member 208. This movement of the interlock assembly 200 will cause the switch member 208 to switch to the OFF position before the switch member 206 reaches the ON position. In this regard, the bridge assembly 226 should have a thickness that is sufficient to position the bridge assembly above the slidable members 210, 212 at a level at which the bridge assembly 226 may be engaged by or engage the switch members 206, 208. In the illustrated embodiment, the bridge assembly 226 includes two bridge plates 228, 230, but is understood that a single thicker plate could be used or more than two thinner plates.

Additionally, as described above, the interlock assembly is designed to cause one switch member to be moved to an OFF position when the opposite switch member is being moved to the ON position. The interlock assembly however does permit a switch member in the ON position to be moved to the OFF position without causing movement of the opposite switch member. In this regard, the interlock assembly allows both switch members to be in the OFF position at the same time, but does not permit both switch members to be in the ON position at the same time.

Referring briefly again to FIG. 17, preferably, a pair of dowels 252 and 254 are used to prevent the interlock assembly 200 from being removed from the transfer panel. More particularly, the dowels 252 and 254 extend through bores (not numbered) in the switch members 206 and 208, respectively, and have a length sufficient to cover the width of the notches formed in the planar bases 214 and 216, respectively. If the interlock assembly 200 were to be lifted upward, the planar bases 214 and 216 would engage the dowels 252 and 254, respectively, thereby preventing the interlock assembly 200 from being removed.

The interlock assembly 200 is assembled in a relatively straightforward manner. The dowels 252 and 254 are slid into the bores formed in the switch members 206 and 208, respectively. The slidable members 210 and 212 are then slid into position with the planar bases 214 and 216 positioned beneath the dowels 252 and 254. The bridge assembly 226 is then secured to the slidable members 210 and 212 using fasteners 248 and 250.

Figure 20:
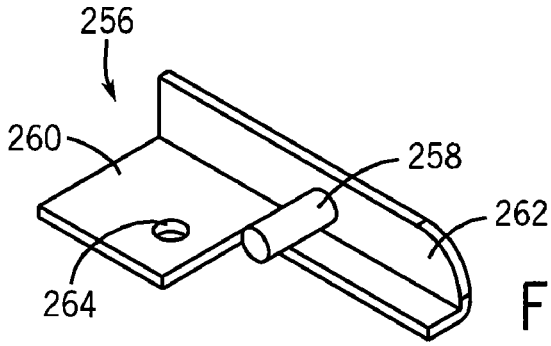
FIG. 20 is an isometric view of an interlock member of a neutral interlock assembly according to another aspect of the invention.

FIG. 20 shows a slidable member 256 according to an alternate embodiment of the invention. In this embodiment, dowel 258 is integrally formed with the slidable member 256, which allows the slidable member 256 to be slid into place from the side of the switch member rather than from above the switch member, which is the case for the slidable members described previously with respect to FIGS. 17-19. The slidable member 256 includes a planar base 260 and a single upturned wall 262. An opening 264 is formed in the base 260 to receive a fastener when the slidable member 256 is coupled to a bridge assembly, such as that described above. The dowel 258 is received within the bore of a switch member such that when the bridge plate(s) are fastened in place, the slidable member 256 cannot be removed.

Figure 21:
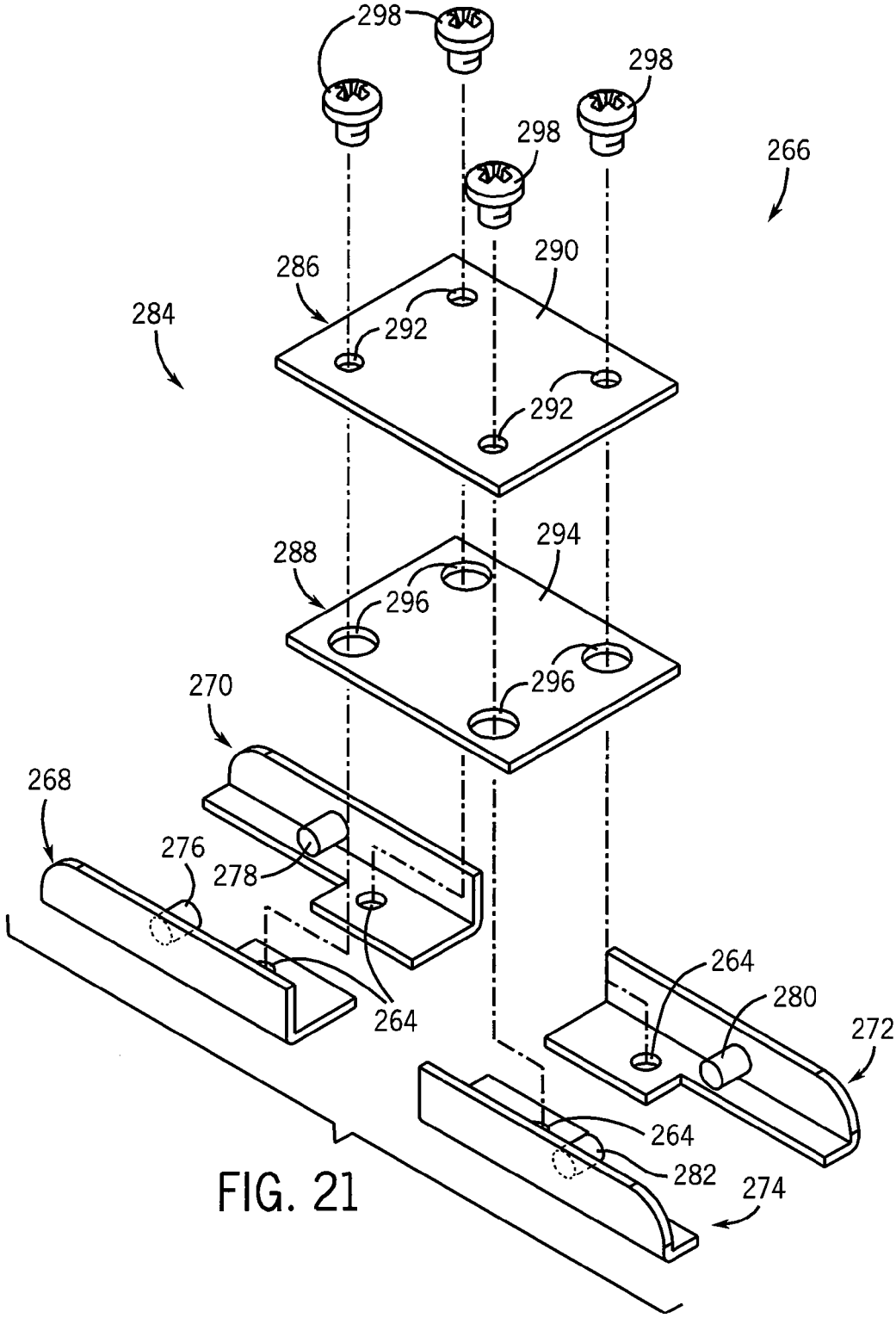
FIG. 21 is an exploded view of a neutral interlock assembly according to yet another aspect of the invention.

FIG. 21 shows an interlock assembly 266 according to another embodiment of the invention and using multiple slidable members according to another embodiment of the invention. Interlock assembly 266 includes four slidable members, designated by reference numerals 268, 270, 272, and 274. Each of the slidable members has an integrated stub 276, 278, 280, and 282, respectively. Stubs 276 and 278 are received within the bore of one switch member, e.g., switch member 206, and stubs 280 and 282 are received within the bore of the opposite switch member, e.g., switch member 208. The stubs 276, 278, 280, and 282 are shorter than the dowels previously described, but are sufficient length to retained within the bores of the switch members. The interlock assembly 266 also includes a bridge assembly 284 that consists of an upper bridge member 286 and a lower bridge member 288. Bridge member 286 is comprised of a plate 290 have four openings 292. Bridge member 288 also comprises a plate 294 having four openings 296. Openings 292 and 296 align with one another and also align with the openings 264 formed in the slidable members. Fasteners 298 may then be used to couple the bridge assembly 284 to the slidable members. It is understood that the bridge assembly may alternately comprise a single bridge member, or more than two bridge members. Also, it is contemplated that the bridge members could be halved to form two pairs of bridge members.

Various alternatives are contemplated as being within the scope of the following claims particularly pointing out and distinctly claiming the subject matter regarded as the invention.

What is claimed is:

1. An electrical assembly for use in combination with an electrical contact arrangement, comprising:

a pair of aligned switches, wherein each of the switches is engaged with the contact arrangement, and wherein each of the switches has an operating member movable between an ON position and an OFF position; and an interlock arrangement including actuating structure that interacts with the switch operating members for preventing both switches from being in the ON position at the same time, wherein the interlock arrangement includes a first slidable member associated with a first one of the operating members; a second slidable member associated with a second one of the operating members; and a bridge member interconnecting the first and the second slidable members; and retention structure extending laterally outwardly from each of the first and second switch operating members, wherein the retention structure is configured to interact with the first and second slidable members to prevent removal of the interlock arrangement from the switches.

2. The assembly of claim 1 wherein the bridge member comprises a plate positioned above the first and the second slidable members and at least one fastener connecting the plate to the first and the second slidable members.

3. The assembly of claim 2 wherein the interlock arrangement further includes a spacer disposed between the plate and the first and second slidable members.

4. The assembly of claim 1 wherein the first slidable member has a first edge that abuts against the first switch operating member and a second edge, and wherein the second slidable member has a first edge that abuts against the second switch operating member and a second edge, and wherein the second edges of the first and second slidable members abut against one another.

5. The assembly of claim 1 wherein the bridge member is interconnected with the first and the second slidable members such that movement of the first switch operating member towards the second switch operating member causes the second switch operating member to move away from the first switch operating member and movement of the second switch operating member towards the first switch operating member causes the first switch operating member to move away from the second switch operating member.

6. The assembly of claim 4 wherein the first switch operating member and the second switch operating member are movable along a first axis and wherein the first switch operating member and the second switch operating member each has a handle body with an elongated bore formed in the handle body, wherein the elongated bore extends along a second axis orthogonal to the first axis, and wherein the retention structure comprises a first post inserted into the elongated bore of the first switch operating member and a second post inserted into the elongated bore of the second switch operating member, wherein the posts are operative to prevent the slidable members from being disassociated from the operating members.

7. The assembly of claim 6 wherein the first slidable member includes a lower planar member and first and second upturned members spaced from another and extending upwardly from opposed edges of the lower planar member and wherein the second slidable member includes a lower planar member and first and second upturned members spaced from another and extending upwardly from opposed edges of the lower planar member, wherein the first and second upturned members of the first slidable member and the first and second upturned members of the second slidable member cooperate with the first and second posts, respectively, to prevent removal of the interlock arrangement from the switches.

8. The assembly of claim 1 wherein the pair of aligned switches comprises a first neutral switch and a second neutral switch of an electrical panel.

9. The assembly of claim 8 wherein the electrical panel comprises a transfer panel operative to connect a set of electrical loads to an auxiliary power supply when primary power to the set of electrical loads is interrupted.

10. An interlock for use with a pair of aligned switches comprised of first and second switch members spaced from one another and operative to selectively electrically connect an electrical load to either a primary power supply or an auxiliary power supply, comprising:

a first interlock member adjacent to the first switch member and configured to slide with movement of the first switch member;

a second interlock member adjacent to the second switch member and configured to slide with movement of the second switch member;

a bridge interlock member coupled to the first interlock member and the second interlock member such that movement of either one of the first or second interlock members causes corresponding movement of the other one of the first or second interlock members; and retention structure extending laterally outwardly from each of the first and second switch members, wherein the retention structure is configured to interact with the first and second slidable members to prevent removal of the interlock arrangement from the switches.

11. The interlock of claim 10 wherein the first interlock member is configured to slide toward the second switch member when the first switch member is moved toward the second switch member and wherein the second interlock member is configured to slide toward the first switch member when the second switch member is moved toward the first switch member.

12. The interlock of claim 11 wherein the first interlock member has a first planar member, wherein the second interlock member has a second planar member generally coplanar with the first planar member, and wherein the bridge interlock member includes a planar base positioned adjacently atop the first and the second planar members.

13. The interlock of claim 12 further comprising a spacer positioned between the planar base and the first and second planar members.

14. An electrical panel comprising:

a pair of aligned transfer switches including a first switch member operable to selectively interrupt electrical connection to a first conductor and a second switch member operable to selectively interrupt electrical connection to a second conductor, wherein the first switch member interrupts electrical connection to the first conductor when the first switch member is switched away from the second switch member and wherein the second switch member interrupts electrical connection to the second conductor when the second switch member is switched away from the first switch member;

an interlock arrangement operable with the pair of aligned transfer switches to prevent both the first switch member and the second switch member from being switched toward one another at the same time, wherein the interlock arrangement includes a first interlock member movable with the first switch member and a second interlock member movable with the second switch member, and wherein the first and second interlock members are secured to one another such that movement of the first interlock member toward the second interlock member causes the second interlock member to move away from the first interlock member, and such that movement of the second interlock member toward the first interlock member causes the first interlock member to move away from the second interlock member; and retention structure extending laterally outwardly from each of the first and second switch members, wherein the retention structure is configured to interact with the first and second interlock members to prevent removal of the interlock arrangement from the switches.

15. The electrical panel of claim 14 wherein the first and second interlock members are secured to one another via a bridge member connected to the first and the second interlock members.

16. The electrical panel of claim 15 wherein the first switch member and the second switch member are movable along a first axis and wherein the first switch member and the second switch members comprise respective first and second switch handles, each of which includes an elongated bore, wherein the elongated bores extend along a second axis orthogonal to the first axis, and wherein the retention structure includes a first post inserted into the elongated bore of the first switch handle and a second post inserted into the elongated bore of the second switch handle.

17. The electrical panel of claim 14 wherein:

the first switch member and the second switch member are movable along a first axis and wherein the first switch member and the second switch member comprise respective first and second switch handles, each of which includes an elongated bore, wherein the elongated bores extend along a second axis orthogonal to the first axis;

wherein the retention structure comprises a first pair of upturned walls on the first interlock member; a second pair of upturned walls on the second interlock member; a first pin extending through the elongated bore of the first switch member and a second pin extending through the elongated bore of the second switch member wherein the first and second pins are maintained in the elongated bores of the first and second switch members by the first and second pairs of upturned walls, respectively, and wherein the first and second pins engage the first and second interlock members, respectively, to prevent removal of the first and second interlock members from the first and second switches.

18. The electrical panel of claim 17 wherein movement of the first and second switch handles is transferred to the respective first and second interlock members through the respective first and second pins extending into the elongated bore of the respective first and second switch members.

19. The electrical panel of claim 17 wherein:

the first interlock member includes a first planar member having a first upturned wall with a first pin extending axially from the first upturned wall, wherein the first pin is received in a first end of the elongated bore of the first switch handle, and further includes a second planar member having a second upturned wall with a second pin extending axially from the second upturned wall in general alignment with the first pin, and wherein the second pin is received in a second end, opposite the first end, of the elongated bore of the first switch handle, and wherein the first pin and the second pin of the first interlock member generally face one another;

the second interlock member includes a first planar member having a first upturned wall with a first pin extending axially from the first upturned wall, wherein the first pin is received in a first end of the elongated bore of the second switch handle, and further includes a second planar member having a second upturned wall with a second pin extending axially from the second upturned wall in general aligned with the first pin, and wherein the second pin is received in a second end, opposite the first end, of the elongated bore of the second switch handle, and wherein the first pin and the second pin of the second interlock member generally face one another; and the first and second planar members of the first interlock member and the first and second planar members of the second interlock member are fastened to a bridge member connected to the first and the second interlock members.

20. The electrical panel of claim 14 wherein the interlock arrangement is operative to allow movement of one of the switch members away from the other one of the switch members without causing movement of the other one of the switch members.

* * * * *